US006615925B2

(12) United States Patent
Rice

(10) Patent No.: US 6,615,925 B2
(45) **Date of Patent: *Sep. 9, 2003**

(54) PUMP CONTROL METHOD AND APPARATUS

(75) Inventor: Timothy F. Rice, Tarpon Springs, FL (US)

(73) Assignee: Global Energy Research LLC, Tarpon Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/265,049

(22) Filed: Oct. 4, 2002

(65) Prior Publication Data

US 2003/0034161 A1 Feb. 20, 2003

Related U.S. Application Data

(63) Continuation-in-part of application No. 09/960,130, filed on Sep. 21, 2001, which is a continuation-in-part of application No. 09/827,446, filed on Apr. 6, 2001, now Pat. No. 6,460,622.

(51) Int. Cl.[7] ..... E21B 43/00

(52) U.S. Cl. ..... 166/369; 166/53; 417/36

(58) Field of Search ..... 166/53, 66, 369, 166/168; 412/2, 212, 36, 904; 294/68.22

(56) References Cited

U.S. PATENT DOCUMENTS

| | | | | | |
|---|---|---|---|---|---|
| 3,044,403 | A | | 7/1962 | Ronk | |
| 3,072,193 | A | | 1/1963 | Ziegler et al. | |
| 3,424,002 | A | * | 1/1969 | Johnson | 73/290 R |
| 3,778,029 | A | * | 12/1973 | Baker | 251/315.1 |
| 3,812,422 | A | * | 5/1974 | De Carolis | 324/642 |
| 4,037,662 | A | | 7/1977 | Bowling | |
| 4,086,035 | A | * | 4/1978 | Klaeger et al. | 417/410.1 |
| 4,368,909 | A | | 1/1983 | Alexander, Jr. | |
| 4,516,911 | A | | 5/1985 | Senghaas et al. | |
| 4,583,916 | A | * | 4/1986 | Senghaas et al. | 417/36 |
| 4,685,522 | A | * | 8/1987 | Dixon et al. | 166/372 |
| 4,751,969 | A | | 6/1988 | Klaeger | |
| 5,097,901 | A | | 3/1992 | Klaeger | |
| 5,251,696 | A | | 10/1993 | Boone et al. | |
| 5,314,016 | A | | 5/1994 | Dunham | |
| 5,316,085 | A | | 5/1994 | Dawson | |
| 5,941,305 | A | * | 8/1999 | Thrasher et al. | 166/53 |
| 6,460,622 | B1 | * | 10/2002 | Rice | 166/369 |
| 2002/0046221 | A1 | * | 4/2002 | Wallace et al. | 707/513 |

* cited by examiner

*Primary Examiner*—David Bagnell
*Assistant Examiner*—Daniel P Stephenson
(74) *Attorney, Agent, or Firm*—Dennis G. LaPointe; Mason Law, PA

(57) ABSTRACT

Apparatus and system control and method for the removal of fluids and gas from a well comprising a winch for removing the oil, a temporary storage tank, a bailer tube, and a bailer tube housing assembly axially aligned with the well casing. Natural gas is exhausted and recovered. The bailer tube is capable of being lowered into and elevated from the well casing such that captured oil can be diverted and discharged into the temporary storage tank. Sensors for monitoring operational parameters including the depth of oil and depth of a top level of water in the well casing, and a programmable logic controller for providing system control so that only oil is removed from the well casing by using a logging sequence and a balanced oil production operational sequence are included.

28 Claims, 18 Drawing Sheets

PUMP CONTROL METHOD AND APPARATUS

RELATED APPLICATIONS

This application is a continuation-in-part application of related U.S. patent application Ser. No. 09/960,130 filed Sep. 21, 2001, which is a continuation-in-part of U.S. patent application Ser. No. 09/827,446 filed Apr. 6, 2001.

BACKGROUND OF THE INVENTION

1. Field of the Invention

The invention relates to an oil bailer apparatus for use in bailing oil from an oil well as well as removing natural gas, wherein a bailer tube is lowered to collect the fluid and raised above ground for the depositing of the fluids into a reservoir.

2. Description of Related Art

Oil bailers are known in the art. However, previous methods of extracting oil, in particular, the bailers and controls used with such bailers fail to differentiate between oil and water in a given well. The problem of non-differentiating between water and oil is especially experienced in low producing wells.

Known related art includes the solid state control system for the oil bailer depicted in U.S. Pat. No. 4,516,911 to Senghaas et al., the oil bailer depicted in U.S. Pat. No. 4,368,909 to Alexander, Jr., and the automated bailer depicted in U.S. Pat. No. 4,037,662 to Bowling.

None of the devices in the above references solve the problem of differentiating between water and oil, especially in low producing wells, and at the same time, address the recovery of natural gas from the oil pumping operation.

It is therefore the intention of this invention to provide an improved oil bailing system, which differentiates between oil and water in a given well, removes only oil, capable of operating on 5,000 foot wells and operates at the removal rate of 25–35 barrels per day. The invention can differentiate between water and oil by the incorporation in the system design of a programmable logic control (PLC) to operate the mechanical system portion of the apparatus, and to provide means for accessing and collecting data of the operation of the equipment including system errors. This will be used to gather and record daily gas and oil production and then transfer all data to a central terminal PC by way of the internet.

SUMMARY OF THE INVENTION

The invention which is an apparatus and system control for the removal of fluids and gas from a well includes means for removing fluids from a well casing, and the fluids being substantially oil and water.

The means for removing fluids from the well casing is coupled directly to an upper end of the well casing and further includes a bailer tube sized to allow an up and down travel of the bailer tube inside the well casing and inside a bailer tube housing assembly vertically aligned with the well casing. The direct coupling may be made by a number of ways known in the art such as a flanged pipe connection or preferably a union connection. The bailer tube housing assembly has an actuated 3-way valve means proximate a lower end of the bailer tube housing assembly for selectively opening the bailer tube housing assembly when allowing the bailer tube to travel into the well casing and for closing the bailer tube housing assembly after the bailer tube has traveled up into the bailer tube housing assembly and for directing a captured column of oil to a temporary storage tank.

Also included is pulley means proximate an upper end of and above the bailer tube housing assembly over which a cable wire attached to an upper end of the bailer tube is run. An opposite end of the cable wire is attached to driven winch means for pulling the bailer tube out of the well casing and for lowering the bailer tube into the well casing. A lower end of the bailer tube has a bailer valve for selectively capturing the column of oil inside the well casing when said bailer tube is lowered therein, and for discharging said captured column of oil into the temporary storage tank when the bailer tube is raised out of the well casing. The bailer valve is typically a two-way direct current (DC) valve.

The bailer valve is in electrical operative communication with a programmable logic controller (PLC) means for monitoring, operating and controlling the apparatus and for translating readable information to obtain and record operational parameters. The PLC means is typically an electrical enclosure housing with various processing capabilities which includes a micro-processing unit typical of computers, gauges for monitoring various desired operating parameters such as flow rates of oil and gases, oil level in the temporary storage tank, pressures, bailer tube travel speeds, etc., actuator switches for activating and controlling the winch and pumping means to empty the temporary storage tank, among several other necessary or desired functions.

The lower end of the bailer tube further includes at least one oil and water sensing means, that is, at least one oil sensor and at least one water sensor, for differentiating between the water and oil inside the well casing as the bailer tube descends therein, the oil and water sensing means facilitating the defining of a top of the water and a bottom of a well casing column of oil. The cable wire is typically a multiple conductor cable wire, which is in electrical communication between the bailer valve and the driven winch means.

The cable wire is also electrically and operatively connected to the programmable logic controller means. The programmable logic controller means calculates an optimum depth required for removal of oil without water from the well casing and once correctly positioned, the bailer valve is closed thereby capturing oil inside said bailer tube and the bailer tube is elevated so that the bailer valve is inside the bailer housing assembly and above the actuated 3-way valve means at which location, the actuated 3-way valve means is closed after which the bailer valve is opened and the captured oil in the bailer tube is discharged into the temporary storage tank. The actuated 3-way valve means, the driven winch means, the oil and water sensor means are each in electrical and operative communication with the programmable logic controller means. The programmable logic controller means controls and monitors a speed of the bailer tube at each location of the bailer tube inside the well casing as the bailer tube is being lowered into and elevated out of the well casing.

The invention further includes natural gas recovery means for recovering a natural gas exhausting from the well casing. The natural gas recovery means comprises a gas and oil separator means, which directs the natural gas exiting the well casing from a location below the actuated 3-way valve means, and means for draining a condensate and means for directing a separated gas to gas distribution means.

The oil and water sensor means is typically a ground probe switch which is activated when a conductive path between a terminal of said ground probe switch is established as the terminal contacts the water under the oil in the well casing thereby defining the top of the water and the bottom of the well casing column of oil.

The driven winch means preferably further comprises encoder means in electrical communication with the programmable logic controller means for converting a rotation of the winch means into a linear motion to determine a speed of the bailer tube traveling inside the well casing and a location within said well casing.

The temporary storage means comprises means for monitoring the level of captured oil in the temporary storage tank, and actuation means operatively connected to pumping means for pumping the captured oil from the temporary storage tank to a predetermined storage location.

The actuated 3-way valve means is preferably one of a slide gate valve and a ball valve.

The natural gas recovery means further comprises means for monitoring one of a flow rate of natural gas exhausting from the well casing, a volumetric quantity of natural gas exhausting from the well casing, and a combination thereof. A corresponding natural gas recovery means data from the means for monitoring one of the flow rate of natural gas exhausting from the well casing, the volumetric quantity of natural gas exhausting from the well casing, and the combination thereof is transmitted to the programmable logic controller means.

Support and guide means at the upper end of the bailer housing assembly for supporting and guiding the wire cable are also included. The support and guide means comprises a stuffing box and sheave assembly including at least one wire cable line wiper and at least one hydraulic greasing port for greasing said wire cable. Typically, the stuffing box and sheave assembly includes a first hydraulic greasing port in overlying relationship to a first line wiper, a second hydraulic greasing port in underlying relationship to the first line wiper and a second line wiper in underlying relationship to the second hydraulic greasing port.

The invention further comprises a proximity sensor switch located proximate the upper end of the bailer housing assembly. The proximity sensor switch is in electrical communication with the programmable logic controller means and being means for stopping the bailer tube being raised from the well casing. A back up proximity sensor switch located in a predetermined spaced apart relationship with the proximity sensor switch, typically about 4–8 inches above the proximity sensor switch, is included and acts as means for stopping the bailer tube should the proximity sensor switch fail. This switch is also in electrical communication with the programmable logic controller means.

The programmable logic controller means further monitors a top of the oil column location within the well casing as well as a bottom location of the oil column within the well casing, the bottom location corresponding to a location of the top of the water column within the well casing. The optimum depth in the well casing of the lower end of the bailer tube for capturing the column of oil without water is an intermediate location between the location of the top of the oil column and above the location of the bottom of the oil column.

The programmable logic controller means performs an operational logging sequence during which the programmable logic controller means operationally opens the bailer valve and the actuated 3-way valve means, starts the lowering of the bailer tube into the well casing accelerating to a predetermine adjustable travel speed, allows the bailer tube to descend to a preset logging depth above the location of the top of the oil column within the well casing, decreases the adjustable travel speed so that the lower end of the bailer tube enters into the oil column at which point the oil sensor means identifies a depth of the top of the oil column, the lower end of the bailer tube continues to descend until the water sensor means identifies a depth of the top of the water in the well casing, transmits data reflective of the identification of the depth of the top of the oil and water to the programmable logic controller means which recalculates desired operational parameters including a new logging depth, optimum depth and bailer tube travel speed, closes the bailer valve, starts elevating the bailer tube through the well casing until the bailer tube enters the bailer tube housing assembly, stops the bailer tube when the lower end of the bailer tube is above the actuated 3-way valve means, closes the actuated 3-way valve means, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired.

The programmable logic controller means also performs a balanced oil production operational sequence during which the programmable logic controller means operationally opens the bailer valve and the actuated 3-way valve means, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the second end of the bailer tube enters into the oil column at which point the oil sensor means identifies a depth of the top of the oil column, the lower end of the bailer tube continues to descend into the oil column and stops at the optimum depth at which point the bailer valve is closed after a predetermined preset dwell time to capture oil, transmits data reflective of the identification of the depth of the top of the oil and optimum depth to the programmable logic controller means which continually calculates and monitors desired operational parameters including the logging depth, optimum depth and bailer tube travel speed, starts elevating the bailer tube through the well casing until the upper end of the bailer tube enters the bailer tube housing assembly, stops the bailer tube when the lower end of the bailer tube is above the actuated 3-way valve means, closes the actuated 3-way valve means, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence as desired.

The programmable logic controller means further monitors an accumulated level of oil in the temporary storage tank, monitors gaseous pressure, monitors oil pressure in the well casing and temporary storage tank using corresponding pressure sensor means, and monitors a tension in the cable wire.

The invention further comprises a field communicator, which is operatively in communication with the programmable logic controller means. The field communicator is operatively in communication with a data base server, the data base server for storing, organizing and polling data outputted from the programmable logic controller means, for users to change operating parameters of the programmable logic controller means, for providing historical data and performing diagnostics, and for providing data collection, reporting, analysis and visualization displays. The data base server is accessible by a user through a website. Another embodiment is the inclusion of a paging system in operative communication with the programmable logic controller means, the paging system for communicating pre-set alarms and messages between a field service department and the programmable logic controller means.

The inventive method comprises the steps of providing an apparatus and system control for the removal of oil and gas from a well as described above; conducting a first sequence logging process during which the programmable logic controller means operationally opens the bailer valve and the actuated 3-way valve means, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the lower end of the bailer tube enters into the oil column at which point the oil sensor means identifies a depth of the top of the oil column, the second end of the bailer tube continues to descend until the water sensor means identifies a depth of the top of the water in the well casing, transmits data reflective of the identification of the depth of the top of the oil and water to the programmable logic controller means which recalculates desired operational parameters including a new logging depth, optimum depth and bailer tube travel speed, closes the bailer valve, starts elevating the bailer tube through the well casing until the bailer tube enters the bailer tube housing assembly, stops the bailer tube when the lower end of the bailer tube is above the actuated 3-way valve means, closes the actuated 3-way valve means, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired; and performing a balanced oil production operational sequence during which the programmable logic controller means operationally opens the bailer valve and the actuated 3-way valve means, starts the lowering of the bailer tube into the well casing accelerating to the predetermine adjustable travel speed, allows the bailer tube to descend to the pre-set logging depth above the location of the top of the oil column within the well casing, decreases the adjustable travel speed so that the lower end of the bailer tube enters into the oil column at which point the oil sensor means identifies the depth of the top of the oil column, the lower end of the bailer tube continues to descend into the oil column and stops at the optimum depth at which point the bailer valve is closed after the predetermined preset dwell time to capture oil, transmits the data reflective of the identification of the depth of the top of the oil and optimum depth to the programmable logic controller means which continually calculates and monitors desired operational parameters including the logging depth, optimum depth and bailer tube travel speed, starts elevating the bailer tube through the well casing until the first end of the bailer tube enters the temporary storage tank, stops the bailer tube when the lower end of the bailer tube is above the actuated 3-way valve means, closes the actuated 3-way valve means, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence until a change in depth is noted such as to require re-initiation of the logging process.

The programmable logic controller means can be programmed to cycle through the first sequence logging process at predetermined time intervals. The programmable logic controller means monitors the rate that the oil column is decreasing or increasing and makes necessary adjustments to slow down or speed up a normal running sequence. The normal running sequence starts out with the travel speed at an optimum operating speed and as a rate of the oil column is decreasing, the programmable logic controller means compares this rate with a current rate of speed of the bailer tube and slows the travel speed of the bailer tube slightly with every cycle, and while monitoring the rate of decrease of the oil column, the programmable logic controller means continuously makes small adjustments until the oil column stops decreasing in size and maintains a steady constant size. The programmable logic controller means continues to run at the travel speed of the bailer tube while continuing to monitor the size of the oil column, and continues to make adjustments in order to maintain a balanced sized oil column.

In another embodiment of the invention, the PLC means for one or more field sites is operatively connected with one or more Field Communicator PCs, each including a dial up modem, ISDN connector and an FTP router, which in turn communicates with a data base server PC. This server is accessible through a website in which data collection, reporting, analysis and visualization displays can be viewed by a customer base. In addition, each PLC means is operatively in communication with a paging system, which outputs data to a field service department.

BRIEF DESCRIPTION OF THE DRAWING

For a fuller understanding of the nature and objects of the invention, reference should be made to the following detailed description, taken in connection with the accompanying drawings, in which.

DESCRIPTION OF THE PREFERRED EMBODIMENT

Figure 1A:
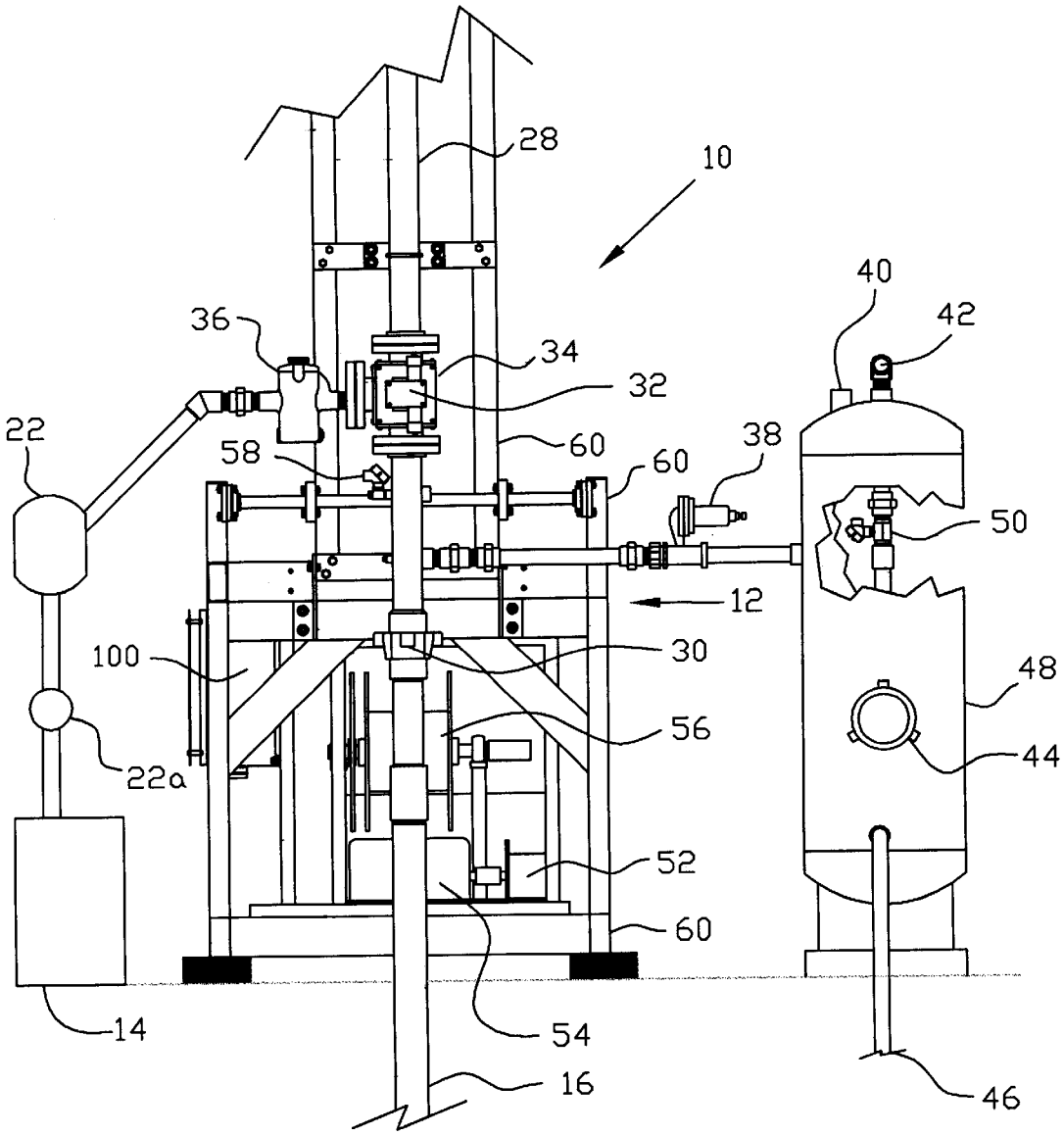
FIG. 1*a* is a schematic partial view of a lower portion of the invention.
Figure 1B:
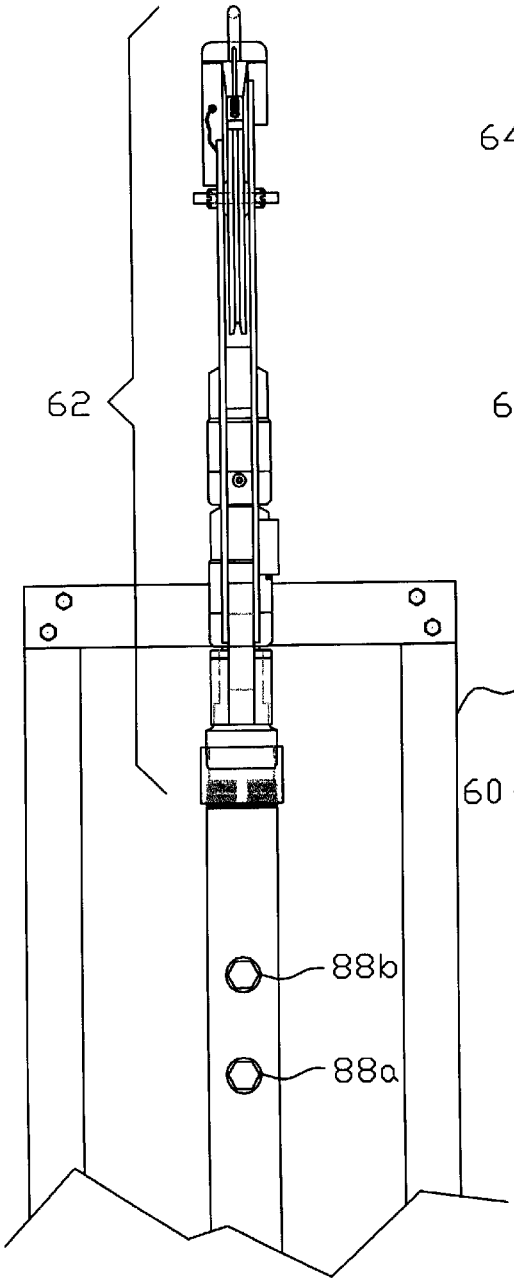
FIG. 1*b* is a schematic partial view of an upper portion of the invention looking from an edge view.

Before referring to the drawings, the following is a general and simplified description of a typical application of the structure and its operation.

The mechanical structure is typically directly attached to the oil casing by means of a union, which supports the bailer housing assembly. The lower bailer housing is equipped with a pressure sensor, which monitors the gas pressure through the PLC and a gas flow meter, which monitors gas flow input in cubic feet per minute (CFM) through the PLC. The remainder of the bailer housing includes a 3-way 4" hydraulic actuated ball valve, a 4" flanged pipe and a line wiper with grease injection/sheave assembly.

The ball valve is used to close off the entry to the oil casing during the depositing operation thus allowing transfer of the oil to the holding tank and prevention of gas back flow to the holding tank. The flanged bailer housing is designed long enough to house the 11 ft long bailer assembly. The line wiper and sheave assembly system is used to prevent escapement of gases and oil from the topside of the bailer housing whereas the sheave or pulley means is used to support and guide the wire line or cable. The greasing unit is driven and operated by a hydraulic drum pump motor and interfaced with the PLC to operate on an hourly or as needed schedule.

The wire lines typically are of a 5⁄16" (0.331) diameter, 7 conductor-jacketed cables with seven conductive wires weaved under the wire and jacket. Two of the conductive wires are used to activate (open and close) the electrical bailer solenoid valve upon the sequence of operation. Four wires are used to gather the signal(s) from the two liquid sensors, while leaving one as a spare.

The topside end of the cable is attached to a hydraulic driven winch, which is used to rise and lower the wire line attached to the bailer in and out of the casing. All incoming signals and outgoing 24 VDC power is transmitted through the winch and wire and tied back to the PLC for operational and informational data.

The bailer tube is typically a 3" pipe capable of holding 4 gallons of oil which will case a 2 way 24V DC valve at the bottom of the bailer to allow the capture and discharge of the oil. Part of the valve assembly consists of an oil and water sensor to differentiate between water and oil level.

A proximity switch is mounted in a location where the bailer tube is stopped once it is fully extended out of the oil casing and above the ball valve where oil can be discharge without reentering the oil casing.

An approximate 60 gallon oil reservoir tank or temporary storage tank is typically mounted to the mainframe structure or on its own independent frame and capable of holding up to 40 gallons of oil. Level switches monitor the oil level in the tank where the oil is removed with the use of a pump to a larger storage tank. A pressure switch is used monitor the pressure in the tank.

An optional fluid injection pump is linked to the PLC to supply a fluid as required to break down heavy paraffin wells as required per well.

The electrical enclosure consist of a PLC which operates and controls the mechanical functions of the mechanical system and translates readable information to obtain operating data such as, but not limited to, the following:

Travel Speeds of the bailer
Depth location of bailer
Linear Travel (Encoder)
Speed of Bailer
Location of the Bailer
Oil vs. Water sensing from Bailer ball valve assembly
Flow meter and volume of Gas intake per day
Flow meter and volume of Oil intake per day
Level sensor of oil in the tank reservoir
Encoder to monitor linear travel
Turning on/off the pump delivering oil to the holding tank
Cycles per minute
Pressure sensing of gas
Pressure sensing of oil
Pressure of reservoir
Translate information to a remote location
Balance oil production
Tension sensing or slack detection in the wire line In a typical sequence of operation, with the bailer tube ball valve in the open position, the wire line winch releases the bailer tube slowly into the hole of the casing at an adjustable slow speed. The speed gradually increases at a given parameter and begins downward travel at an adjustable higher rate called "travel speed". An encoder built into the wire line winch converts RPM to linear motion through the PLC therefore, always knowing the location of the bailer. As the bailer tube reaches the oil column the speed is slowed down for easier entry. The oil liquid sensors identify the exact location liquid level begins, differentiates between oil and water and communicates the information back to the PLC. The tube continues to travel downward until a second sensor (water), also located at the leading edge of the bailer is activated upon making contact with a second source fluid. The PLC stores this information for future use. This level is known as the top of the water and bottom of the oil column. The sensor(s) can differentiate between the oil and water. The PLC automatically calculates the optimum depth required for removing the oil without removing water. Once correctly positioned, the bailer tube valve is closed and the bailer begins its travel upward to the surface. The return speed is gradual and increases to the "travel speed" at a given parameter. As the bailer tube reaches the surface and before entering the bailer housing, its speed is decreased by a proximity switch located at the top of the retrieval tube. A secondary switch mounted in the same general location stops the travel of the tube. A second sensor is located 6 inches above the first sensor to act as a safety or over ride to stop travel if first sensor fails. The 3-way 4" ball valve is then closed and the bailer valve containing the oil is then opened thus allowing the oil to be diverted and transferred to the holding tank. Once fully drained, the 3-way 4" ball valve is actuated to the bailer pass through position and prepared to repeat the process.

The above first sequence is referred to as the "Logging Process". The logging process provides the necessary data required for the PLC to pre-determine target settings.

As the oil extraction process begins, the weight of the oil column decreases due to the decreasing size of the oil column, the water under the oil column may drive the oil column higher resulting in a change in the location of the top of the oil column.

The PLC continuously monitors the location of the top of the oil column and the depth in order to "balance" the oil column, resulting in a faster or slower cycle rate. For this reason the logging process must repeat approximately every five cycles.

The second part of the operation sequence is the balancing process. The normal operating target or depth setting would be the center of the oil column but could be changed if necessary depending on the location oil vs. water. The PLC then would automatically calculate this distance and under normal operation, travel down to this point and stop and dwell for a period of time before starting back up the hole.

Gas removal is typically accomplished according to the following description. A 2" National Pipe Thread (NPT) coupling located above the union, which is connected to the well casing, may be used as the means for gas removal. As the gases rise to the surface, they are allowed to free flow outwards through the gas flow meter thus allowing data to be collected through the PLC. A pressure sensor located and mounted above the union is used to monitor high-pressure situations and shutdown the system if extreme high pressures are present.

The balancing operation sequence begins with the PLC opening the well casing 3-way 4" ball valve. The bailer tube begins its decent into the hole at a slow (adjustable) speed with an adjustable parameter to determine when it picks up speed to "the travel speed." The travel speed is adjustable. The PLC, already knowing the location of the top of the oil column, travels down the hole at "travel speed". As it arrives, an adjustable parameter begins to slow the tube within several feet or inches from the top of the oil column. This allows the tube to lower down into the oil at a safe rate of speed. This slow down parameter is important because the top of the oil column will be changing constantly. The PLC then closes the retrieval (bailer) tube valve after a predetermined amount of time called the dwell time.

The tube begins to travel back up the hole at an adjustable speed until it arrives at the parameter that tells the tube to speed up to a predetermined rate of speed.

The tube travels up to the parameter that tells the tube to slow down to a predetermined rate of speed as it enters in to the bailer housing and arrives at the proximity sensor and stops.

The 3-way 4" ball valve closes and the retrieval tube opens and stays open for a predetermined amount of time before closing. This span of time is called the top dwell time.

The PLC can be programmed to cycle through a logging sequence every so often. Therefore it will monitor the rate that the oil column is decreasing or increasing and make necessary adjustments to slow down or speed up the normal running sequence. The normal running sequence starts out with the travel speed at optimum operating speed and as the rate the oil column is decreasing the PLC compares this rate with the current rate of speed and slows or increases the travel speed slightly with every cycle. While monitoring the rate of decrease, the PLC is continuously making small adjustments until the oil column stops decreasing in size maintaining a steady constant level. The PLC continues to run at this travel speed while continuing to monitor the size of the oil column continuing to make adjustments in order to maintain a balanced size oil column.

The communication and data collection aspects of the invention include the following. The PLC, primarily used to operate the system most efficiently is also used to continuously monitor and collect data. Data collection includes desired parameters such as, but not limited to, the following:

Oil production per hour
Gas production per hour
Level of oil in holding tank
Positioning of bailer in casing
Pressure of Oil holding tank
Gas pressure in casing
Winch wire tension
3-way 4" ball valve position
Travel Speed
Cycles per hour
Fluid injection cycles/Hr
Drum Pump cycles/Hr The system faults typically include:

Oil Pump out motor failure
Oil tank level sensor failure
System shut-down
Bailer stop switch failure
Winch tension switch failure
Bailer valve failure
Bailer sensor failure
3-way ball valve position failure
Fluid injection pump failure
Drum Pump failure
Tank Pressure switch
Bailer housing switch Field communicator(s) (PC's), strategically placed, are typically located locally around the service area and continuously makes call ups to the individual units collecting the following data:

Cycle speed
Cycle rate
Barrels/hr
BTU's of gas/hr

The #1 PC server located in a central operating location such as a company office which may even be in a city or town thousands of miles away from the field site, does daily polling to each field communicator to gather production data and is capable of linking up to any specific unit to make program changes to the PLC program, which include the following:

Cycle time
Dwell time
Depth of bailer
Cycle speed
Cycle rate
Fluid injection rate
Grease injection rate Each unit typically has a call in/out modem capable of linking up the main server or field communicator for data collection, program changes and "dial out" to a paging service to report a unit out of service.

Given the parameters, software, referred to as RS View software, is provided and designed to show pictorial, graphical and numerical displays such as:

Tank level

Bailer location and depth

Barrels/Hr (Oil)

BTU's/Hr (Gas)

Cycle rate

Bailer Speed

Dwell time

Fluid injection rate

Grease injection rate

Tank Pressure

Bailer housing pressure

Referring now to the drawings, in particular FIGS. 1*a*–1*d*, 2–4 and 5*a*–5*e*, the invention which is an apparatus and system control for the removal of fluids and gas from a well and is depicted generally as 10, includes means 12 for removing fluids from a well casing 16, the fluids being substantially oil 18 and water 20.

The means 12 for removing fluids from the well casing is coupled directly to an upper end of the well casing 16 and further includes a bailer tube 90 sized to allow an up and down travel of the bailer tube 90 inside the well casing 16 and inside a bailer tube housing assembly 28 vertically aligned with the well casing 16. The direct coupling may be made by a number of ways known in the art such as a flanged pipe connection or preferably a union connection 30. The bailer tube housing assembly 28 has an actuated 3-way valve means 34 proximate a lower end of the bailer tube housing assembly 28 for selectively opening the bailer tube housing assembly 28 when allowing the bailer tube 90 to travel into the well casing 16 and for closing the bailer tube housing assembly 28 after the bailer tube 90 has traveled up into the bailer tube housing assembly 28 and for directing a captured column of oil 18 to a temporary storage tank 22.

Also included is pulley means or a sheave 64 proximate an upper end of and above the bailer tube housing assembly 28 over which a cable wire 68 attached to an upper end of the bailer tube 90 is run. An opposite end of the cable wire 68 is attached to driven winch means 56 for pulling the bailer tube 90 out of the well casing 16 and for lowering the bailer tube 90 into the well casing 16. A lower end of the bailer tube 90 has a bailer valve 90*a* for selectively capturing the column of oil 18 inside the well casing 16 when said bailer tube 90 is lowered therein, and for discharging said captured column of oil 18 into the temporary storage tank 22 when the bailer tube 90 is raised out of the well casing 16. The bailer valve 90*a* is typically a two-way direct current (DC) valve.

The bailer valve 90*a* is in electrical operative communication with a programmable logic controller (PLC) means 100 for monitoring, operating and controlling the apparatus and for translating readable information to obtain and record operational parameters. The PLC means 100 is typically an electrical enclosure housing with various processing capabilities which includes a micro-processing unit typical of computers, gauges for monitoring various desired operating parameters such as flow rates of oil and gases 112,114, oil level 116 in the temporary storage tank 22, pressures 124, 128, bailer tube travel speeds 102,146 etc., actuator switches for activating and controlling the winch and pumping means 22*a*, 120 to empty the temporary storage tank 22 and transfer its contents to another storage tank 14, among several other necessary or desired functions.

The lower end of the bailer tube 90 further includes oil and water sensing means 70 (70*a*,70*b*) for differentiating between the water 20 and oil 18 inside the well casing 16 as the bailer tube 90 descends therein, the oil and water sensing means 70 (70*a*,70*b*) facilitating the defining of a top of the water 98*a* and a bottom of a well casing column of oil 98*b*. The cable wire 68 is typically a multiple conductor cable wire which is in electrical communication between the bailer valve 90*a* and the driven winch means 56.

The cable wire 68 is also electrically and operatively connected to the programmable logic controller means 100. The programmable logic controller means 100 calculates an optimum depth 98*d* required for removal of oil 18 without water 20 from the well casing 16 and once correctly positioned, the bailer valve 90*a* is closed thereby capturing oil 18 inside said bailer tube 90 and the bailer tube 90 is elevated so that the bailer valve 90*a* is inside the bailer housing assembly 28 and above the actuated 3-way valve means 34 (the hydraulic actuator is designated as 32) at which location, the actuated 3-way valve means 34 is closed after which the bailer valve 90*a* is opened and the captured oil 18 in the bailer tube 90 is discharged into the temporary storage tank 22. The actuated 3-way valve means 34, the driven winch means 56, the oil and water sensor means 70 are each in electrical and operative communication with the programmable logic controller means 100. The programmable logic controller means 100 controls and monitors a speed 102 of the bailer tube 90 at each location or bailer depth 104 of the bailer tube 90 inside the well casing 16 as the bailer tube 90 is being lowered into and elevated out of the well casing 16.

The invention further includes natural gas recovery means for recovering a natural gas exhausting from the well casing 16. The natural gas recovery means comprises a gas and oil separator means 48, which directs the natural gas exiting the well casing 16 from a location below the actuated 3-way valve means 34, and means for draining a condensate 46 and means for directing a separated gas to gas distribution means 42. Also shown in FIG. 1*a* is a pressure regulator 38 for safety reasons, an auxiliary gas distribution port 40 should one be needed, a hammer union trunnion 44 and a gas flow meter 50.

The oil and water sensor means 70 is typically a ground probe switch which is activated when a conductive path between a terminal of said ground probe switch is established as the terminal contacts the water 20 under the oil 18 in the well casing 16 thereby defining the top of the water 98*a* and the bottom 98*b* of the well casing column of oil 18.

Figure 1C:
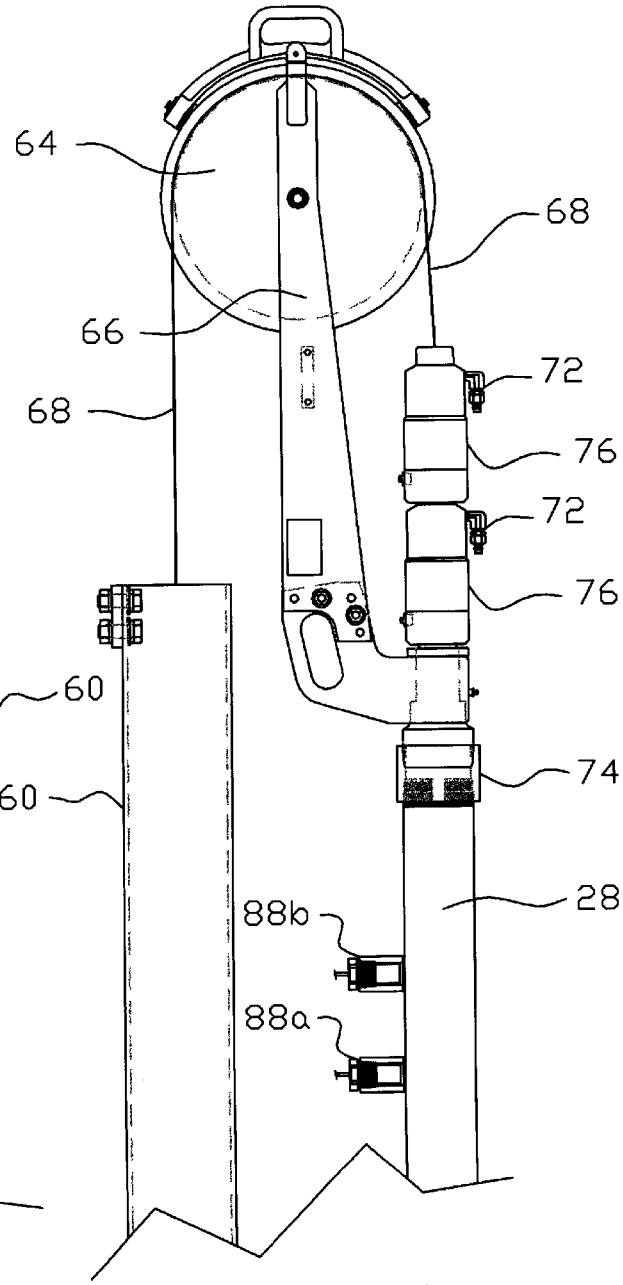
FIG. 1*c* is a schematic partial view of the upper portion of FIG. 1*b* looking from a side view.
Figure 1D:
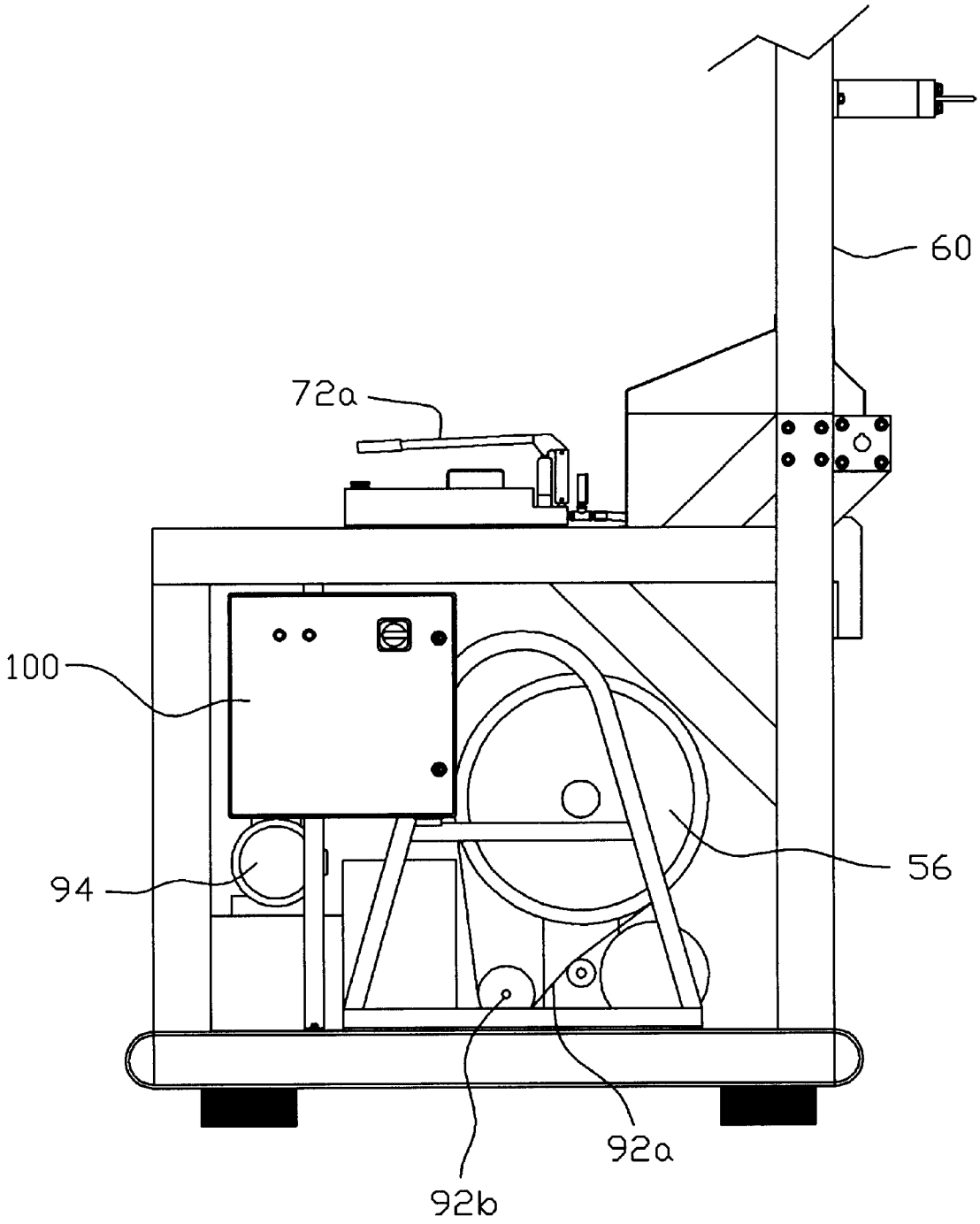
FIG. 1*d* is a schematic partial view from the side of the lower portion of the invention.
Figure 2:
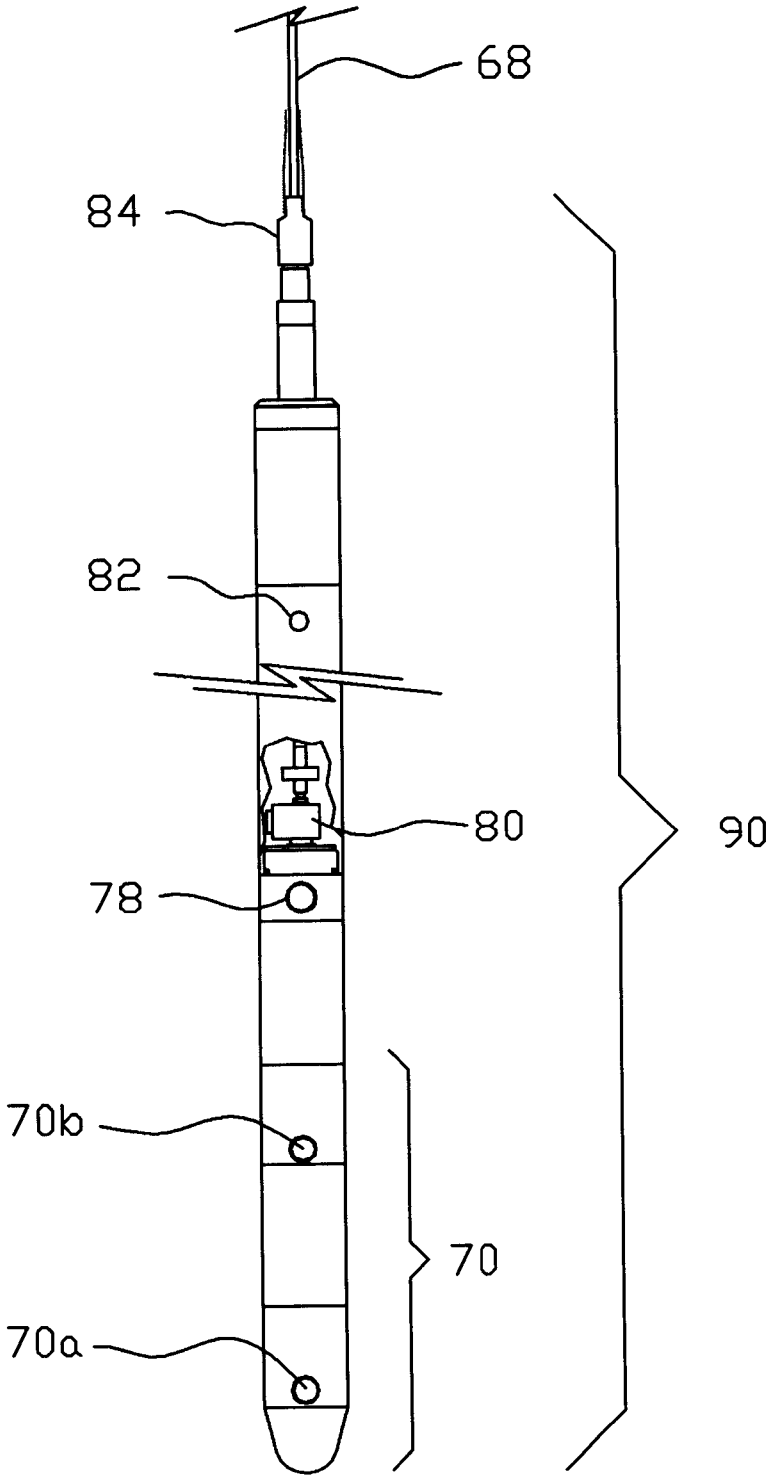
FIG. 2 is a schematic view of the bailer tube assembly.
Figure 3:
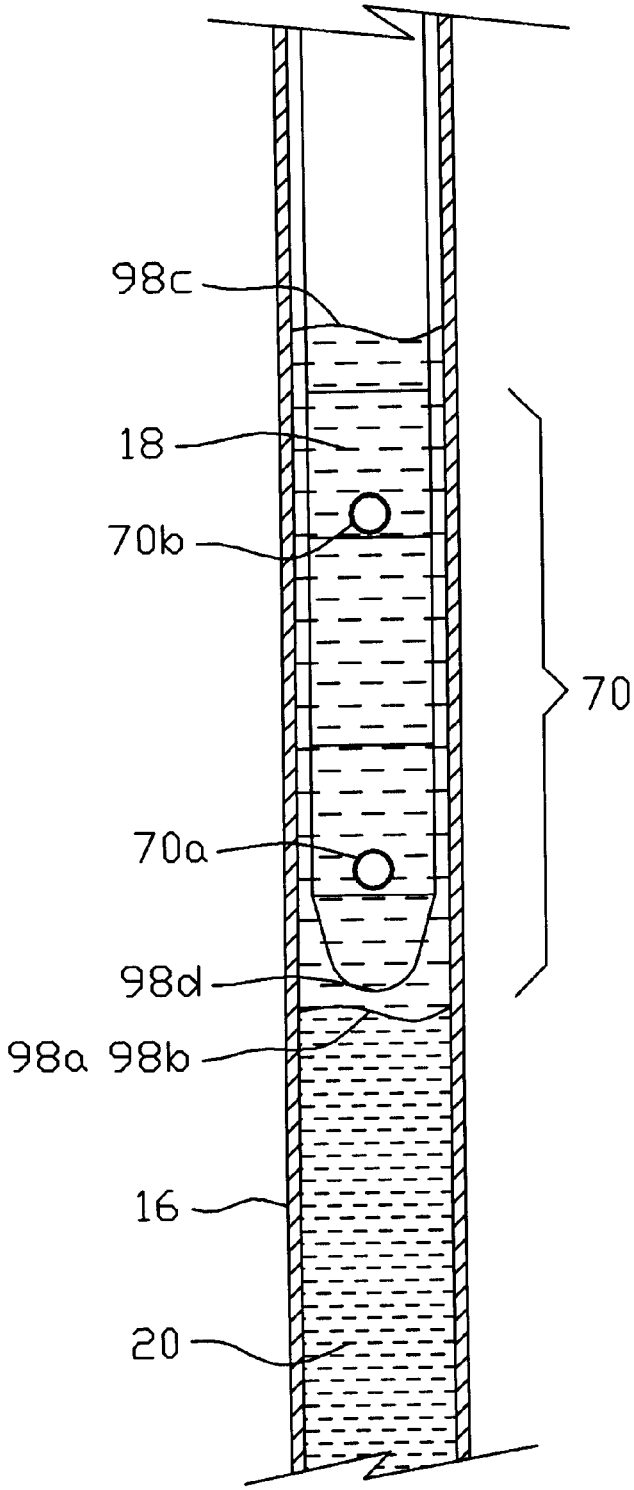
FIG. 3 is a conceptual depiction of the end of the bailer tube inside the well casing at an optimum depth.
Figure 4:
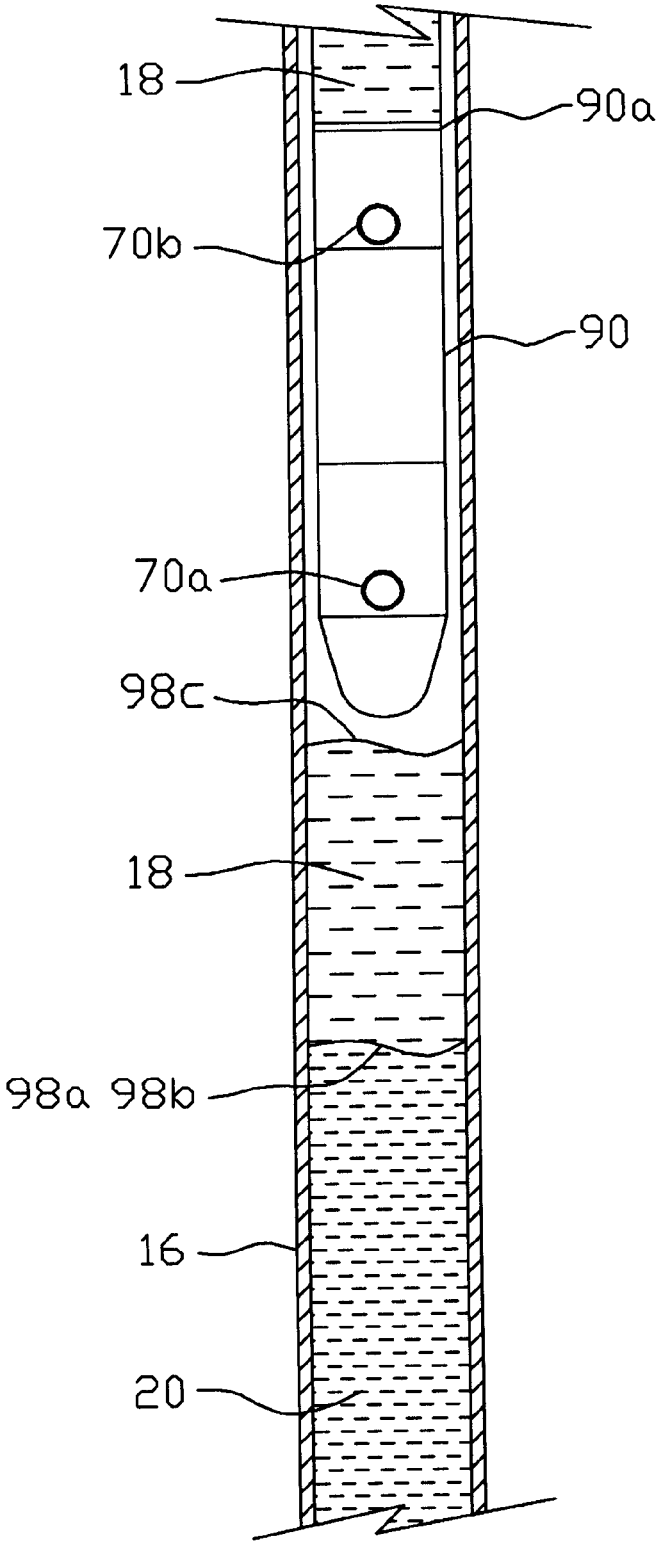
FIG. 4 is a schematic view depicting a captured oil column ascending out of the well casing.

The driven winch means 56 preferably further comprises encoder means in electrical communication with the programmable logic controller means 100 for converting a rotation of the winch means 56 into a linear motion to determine a speed 102 of the bailer tube 90 traveling inside the well casing 16 and a location 104 within said well casing 16. As shown in FIGS. 1*a* and 1*c*, typical components include a chain 92*a* with a drive sprocket 92*b*. Winch means 56 may typically be a sprocket for mating with chain 92*a*. Other typical components include a hydraulic power supply 94 for the hydraulic driven components and a hydraulic hand pump 72*a* which may be connected to grease fitting ports 72.

Included is temporary storage means which comprises means for monitoring the level 116 of captured oil 18 in the temporary storage tank 22, and actuation means operatively connected to pumping means 22*a* for pumping the captured oil 18 from the temporary storage tank 22 to a predetermined storage location 14.

The actuated 3-way valve means 34 is preferably one of a slide gate valve and a ball valve.

The natural gas recovery means further comprises means for monitoring one of a flow rate 50 of natural gas exhausting from the well casing 16, a volumetric quantity of natural gas 112 exhausting from the well casing 16, and a combination thereof. A corresponding natural gas recovery means data from the means for monitoring one of the flow rate 50 of natural gas exhausting from the well casing 16, the volumetric quantity of natural gas 112 exhausting from the well casing 16, and the combination thereof is transmitted to the programmable logic controller means 100.

Support and guide means at the upper end of the bailer housing assembly 28 for supporting and guiding the wire cable 68 are also included. The support and guide means comprises a stuffing box and sheave assembly 62 including at least one wire cable line wiper 76 and at least one hydraulic greasing port 72 for greasing said wire cable 68. Typically, the stuffing box and sheave assembly 62 includes a first hydraulic greasing port 72 in overlying relationship to a first line wiper 76, a second hydraulic greasing port 72 in underlying relationship to the first line wiper 76 and a second line wiper 76 in underlying relationship to the second hydraulic greasing port 72. Typically, assembly 62 includes a pulley or sheave 64 and a sheave support arm 66.

The invention further comprises a proximity sensor switch 88*a* located proximate the upper end of the bailer housing assembly 28. The proximity sensor switch 88*a* is in electrical communication with the programmable logic controller means 100 and being means for stopping the bailer tube 90 being raised from the well casing 16. A back up proximity sensor switch 88*b* located in a predetermined spaced apart relationship with the proximity sensor switch 88*a,* typically about 4–8 inches above the proximity sensor switch 88*a,* is included and acts as means for stopping the bailer tube 90 should the proximity sensor switch 88*b* fail. This switch 88*b* is also in electrical communication with the programmable logic controller means 100.

The programmable logic controller means 100 further monitors a top 98*c* of the oil column location within the well casing 16 as well as a bottom 98*b* location of the oil column within the well casing 16, the bottom location 98*b* corresponding to a location of the top 98*a* of the water column within the well casing 16. The optimum depth 98*d* in the well casing 16 of the lower end of the bailer tube 90 for capturing the column of oil 18 without water 20 is an intermediate location between the location of the top 98*c* of the oil column and above the location of the bottom 98*b* of the oil column.

The programmable logic controller means 100 performs an operational logging sequence during which the programmable logic controller means 100 operationally opens the bailer valve 90*a* and the actuated 3-way valve means 34, starts the lowering of the bailer tube 90 into the well casing 16 accelerating to a predetermine adjustable travel speed 102, allows the bailer tube 90 to descend to a pre-set logging depth above the location of the top 98*c* of the oil column within the well casing 16, decreases the adjustable travel speed 102 so that the lower end of the bailer tube 90 enters into the oil column at which point the oil sensor means 70*a* identifies a depth of the top 98*c* of the oil column, the lower end of the bailer tube 90 continues to descend until the water sensor means 70*b* identifies a depth of the top 98*a* of the water in the well casing 18, transmits data reflective of the identification of the depth of the top 98*c*,98*a* of the oil and water to the programmable logic controller means 100 which recalculates desired operational parameters including a new logging depth, optimum depth and bailer tube travel speed, closes the bailer valve 90*a,* starts elevating the bailer tube 90 through the well casing 16 until the bailer tube 90 enters the bailer tube housing assembly 28, stops the bailer tube 90 when the lower end of the bailer tube 90 is above the actuated 3-way valve means 34, closes the actuated 3-way valve means 34, opens the bailer valve 90*a* for a predetermined top dwell time thereby discharging the captured oil 18 in the bailer tube 90 inside the temporary storage tank 22, closes the bailer valve 90*a* after the captured oil 18 has been discharged into the temporary storage tank 22, and repeats the above operational logging sequence as desired.

The programmable logic controller means 100 also performs a balanced oil production operational sequence during which the programmable logic controller means 100 operationally opens the bailer valve 90*a* and the actuated 3-way valve means 34, starts the lowering of the bailer tube 90 into the well casing 18 accelerating to a predetermine adjustable travel speed 102, allows the bailer tube 90 to descend to a pre-set logging depth above the location of the top 98*c* of the oil column within the well casing 16, decreases the adjustable travel speed 102 so that the lower end of the bailer tube 90 enters into the oil column 18 at which point the oil sensor means 70*a* identifies a depth of the top 98*c* of the oil column, the lower end of the bailer tube 90 continues to descend into the oil column and stops at the optimum depth 98*d* at which point the bailer valve 90*a* is closed after a predetermined preset dwell time to capture oil 18, transmits data reflective of the identification of the depth of the top 98*c* of the oil and optimum depth 98*d* to the programmable logic controller means 100 which continually calculates and monitors desired operational parameters including the logging depth, optimum depth 98*d* and bailer tube travel speed 102, starts elevating the bailer tube 90 through the well casing 16 until the upper end of the bailer tube 90 enters the bailer tube housing assembly 28, stops the bailer tube 90 when the lower end of the bailer tube 90 is above the actuated 3-way valve means 34, closes the actuated 3-way valve means 34, opens the bailer valve 90*a* for a predetermined top dwell time thereby discharging the captured oil 18 in the bailer tube 90 inside the temporary storage tank 22, closes the bailer valve 90*a* after the captured oil 18 has been discharged into the temporary storage tan 22*k,* and repeats the above balanced oil production operational sequence as desired.

Other typical operating structural features shown in the drawings include a basket strainer 36 in the line between the 3-way valve means 34 and the storage tank 22; an electric motor 54 and hydraulic pump 52 for operating the winch means 56; an oil flow meter 58; a coupling 74, typically 4½ inch, at the upper end of the bailer housing assembly 28; a fluid fill port 78 and associated vent port 82; a quick disconnect bailer connector 84; and a bailer coil 80.

The programmable logic controller means 100 further monitors an accumulated level 116 of oil 18 in the temporary storage tank 22, monitors gaseous pressure and oil pressure 124, 128 in the well casing 16 and temporary storage tank 22 using corresponding pressure sensor means, and monitors a tension 134 in the cable wire 68.

The invention further comprises a field communicator 160, which is operatively in communication with the programmable logic controller means 100. The field communicator 160 is operatively in communication with a data base server 162, the data base server for storing, organizing and polling data outputted 138 from the programmable logic controller means 100, for users to change operating parameters of the programmable logic controller means 100, for providing historical data and performing diagnostics, and for providing data collection, reporting, analysis and visualization displays. The data base server 162 is accessible by a user or customer base 166 through a website 164. Another embodiment is the inclusion of a paging system 170 in operative communication with the programmable logic controller means 100, the paging system 170 for communicating pre-set alarms and messages between a field service department 168 and the programmable logic controller means 100.

Referring back to the structure as shown conceptually in the drawings, the contents of the temporary storage tank 22 can optionally be gravity drained to another location such as a transport truck or other storage location (generically shown in FIG. 1*a* as 14), the contents may be pumped to a transport tank or other storage location, or the system may have the capability of gravity draining and pumping the contents whichever suits the needs of the field operator.

Typically, bailer tube housing assembly 28 is made from a 4 inch pipe while the bailer tube 90 is generally a 3 inch pipe of sufficient length and capable of holding in its interior space approximately 4 gallons of oil.

Examples of such other parameters and components monitored by the PLC means 100 may include an oil pump on/off switch 120 for emptying the storage tank 22, a data translator 130, a winch speed indicator 146, bailer location 108, bailer valve open position indicator 148*a* and closed position indicator 148*b,* a data output 138, a cycle per minute indicator 122, a cable wire tension sensor indicator 134, a hydraulic winch level sensor 152, a bailer stop switch sensor indicator 88*a*,88*b,* and a dial up module 136. The data output 138 may be transmitted using a modem 150. That is, the PLC means 100 is a means for monitoring, operating and controlling the apparatus 10 and for translating readable information or output data 138 to obtain and record operational parameters such as the depth of the bailer tube 104, the location of the bailer tube 108, the flow/volume of gas intake 112, the flow/volume of oil intake 114, the bailer tube cycles per minute 122 and the tension in the cable wire 134, among other operational parameters desired in the field.

As mentioned above, the PLC means 100 can be programmed to cycle through the logging sequence mode every so often as well as at the start of operations. Therefore, it will monitor the rate that the oil column 18 is decreasing or increasing and make necessary adjustments to slow down or speed up the normal running sequence. The normal running sequence starts out with the travel speed 102 at optimum operating speed and as the rate the oil column is decreasing, the PLC means 100 compares this rate with the current rate of speed and adjusts the travel speed slightly as needed during the operating cycles. While monitoring the rate of decrease, the PLC means 100 is continuously making small adjustments until the oil column stops decreasing in size maintaining a steady constant size. The PLC means 100 continues to run at this travel speed 102 while continuing to monitor the size of the oil column 18, continuing to make adjustments in order to maintain a balanced sized oil column 18.

The PLC means 100 also activates the actuation means or pump on/off switch 120 which is operatively connected to the pumping means 22*a* for pumping the captured oil 18 from the temporary storage tank 22 when said temporary storage tank 22 accumulates a predetermined level of captured oil 18. Production for a given well is monitored in the PLC means 100 at 112 and 114.

Well operations will typically start with a logging process mode. Based on experience and geological surveys, the field operators generally have an educated feeling as to the depth at which a top 98*c* of an oil column so the logging process can be initiated such that the bailer tube 90 is made to accelerate to a pre-set depth above the expected top 98*c* of the oil column. Of course, if the field operators desire that pre-set depth may be a couple of hundred feet or more to as little as a few inches below the top of the well casing 16.

Figure 5A:
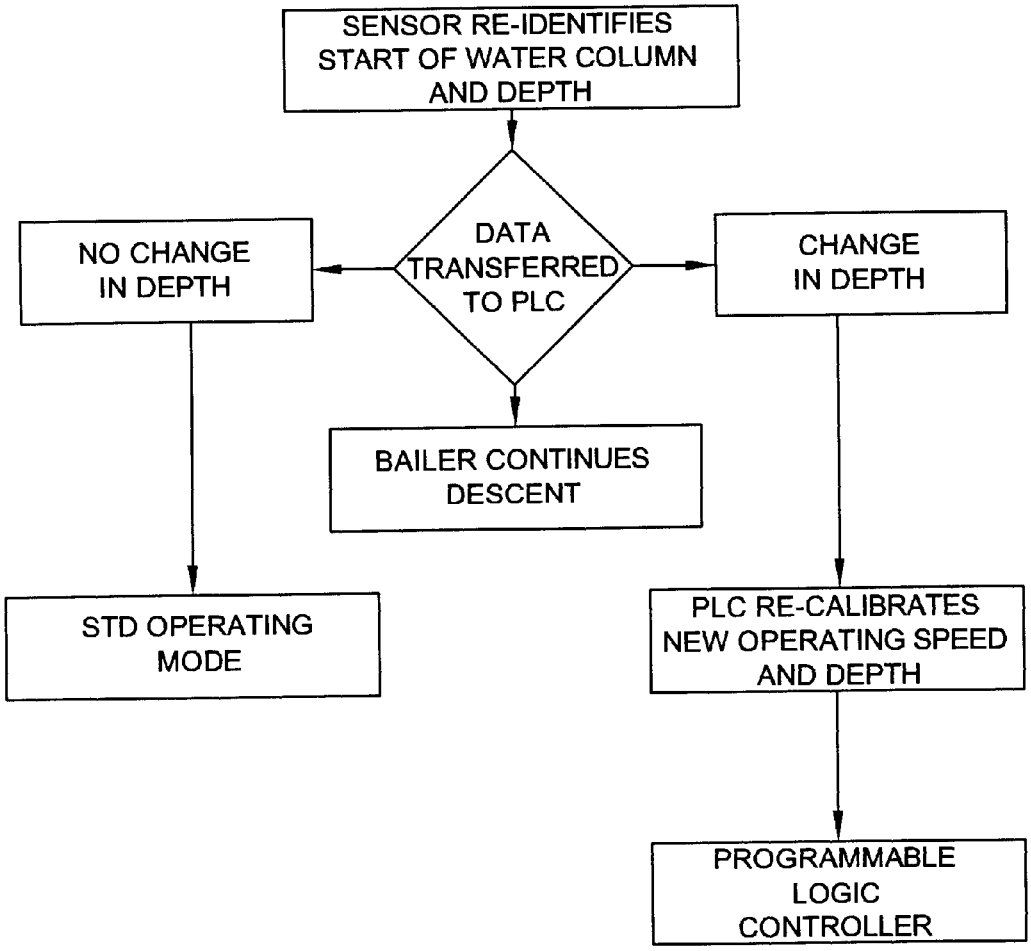
FIG. 5*a* is a diagrammatic flow chart depicting logging process controlled by the PLC means.
Figure 5B:
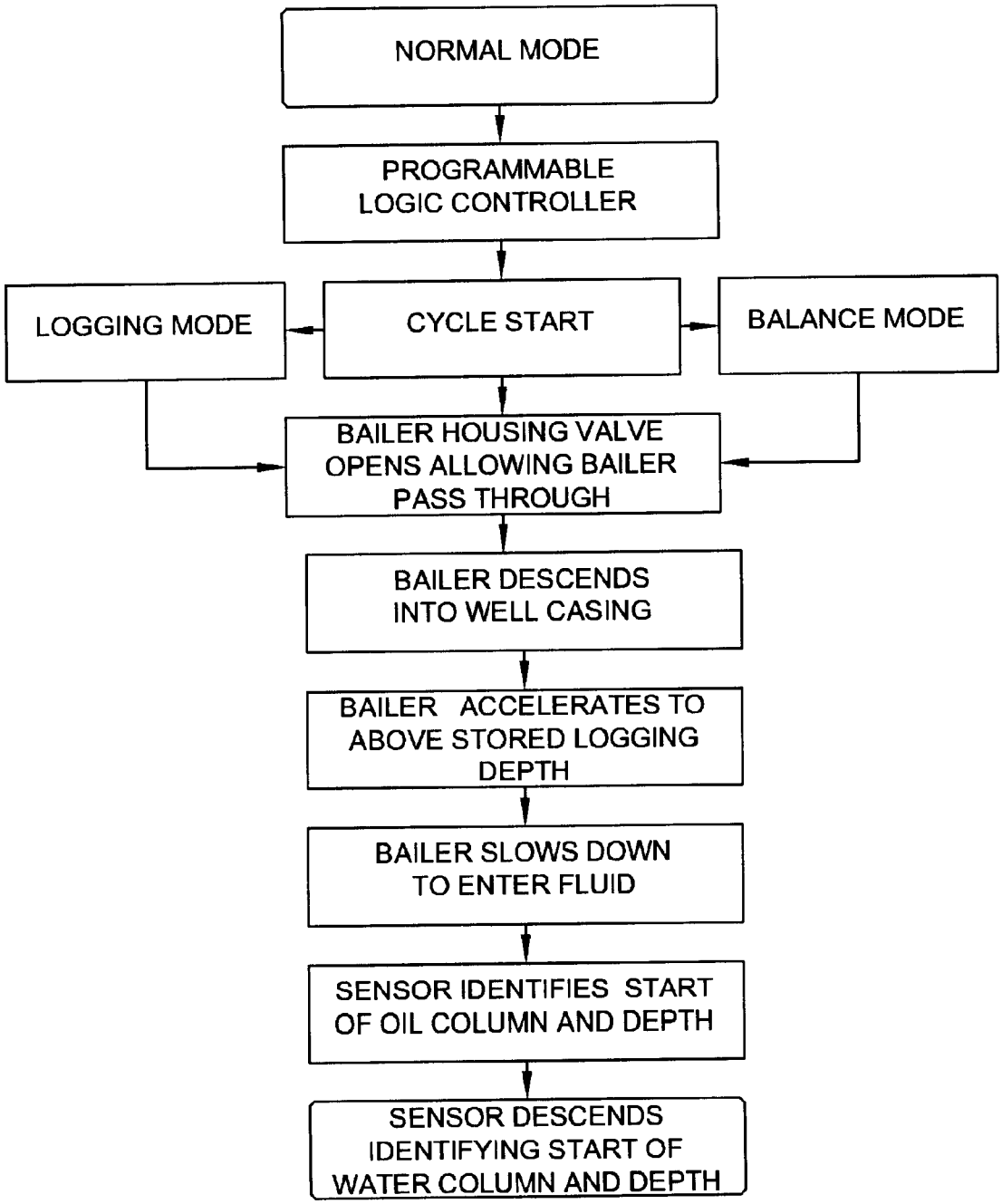
FIG. 5*b* is a diagrammatic flow chart depicting a portion of the normal operational mode of the invention.
Figure 5C:
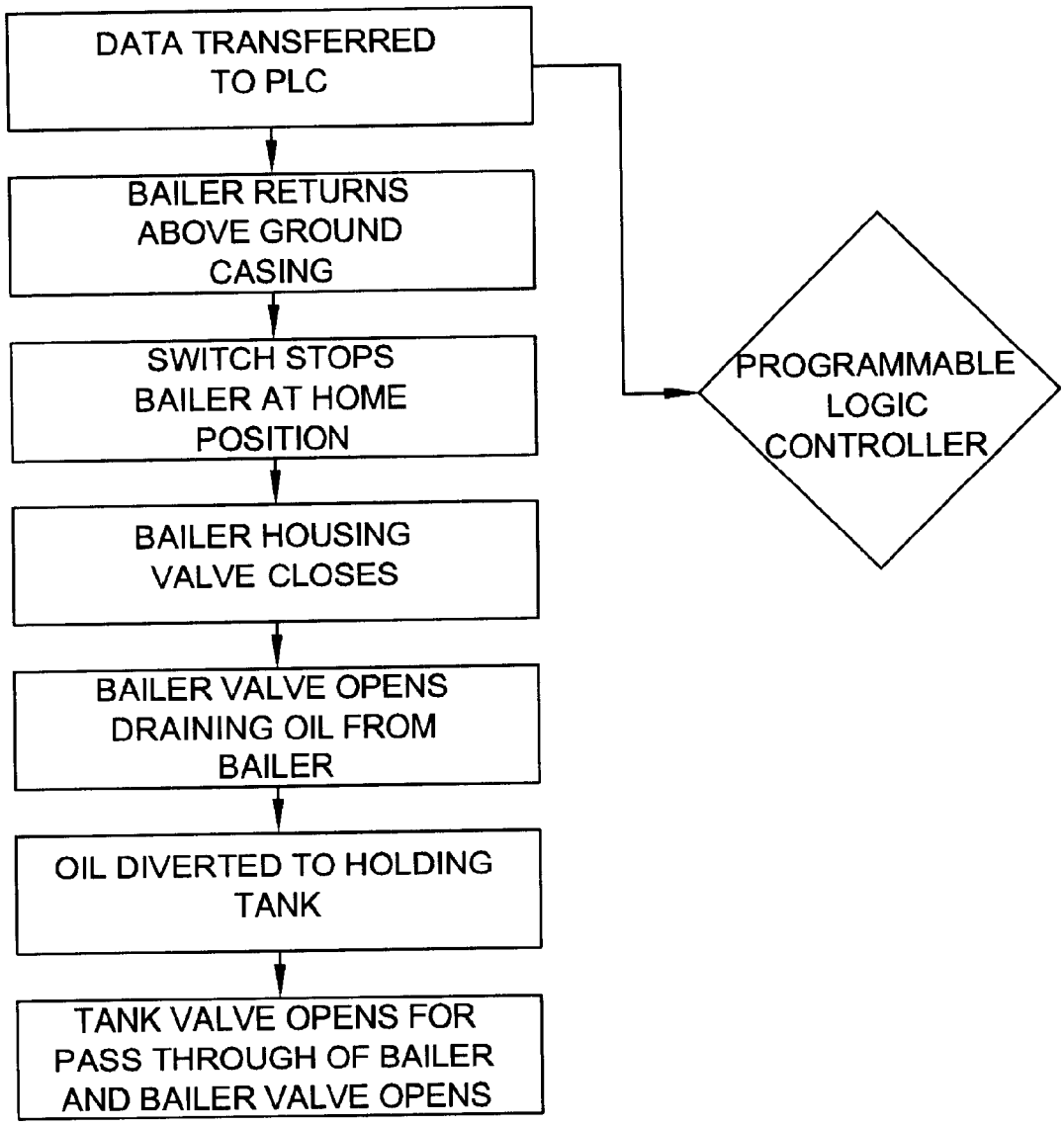
FIG. 5*c* is a diagrammatic flow chart depicting the remaining portion of the normal operational mode started in FIG. 5*b;*
Figure 5D:
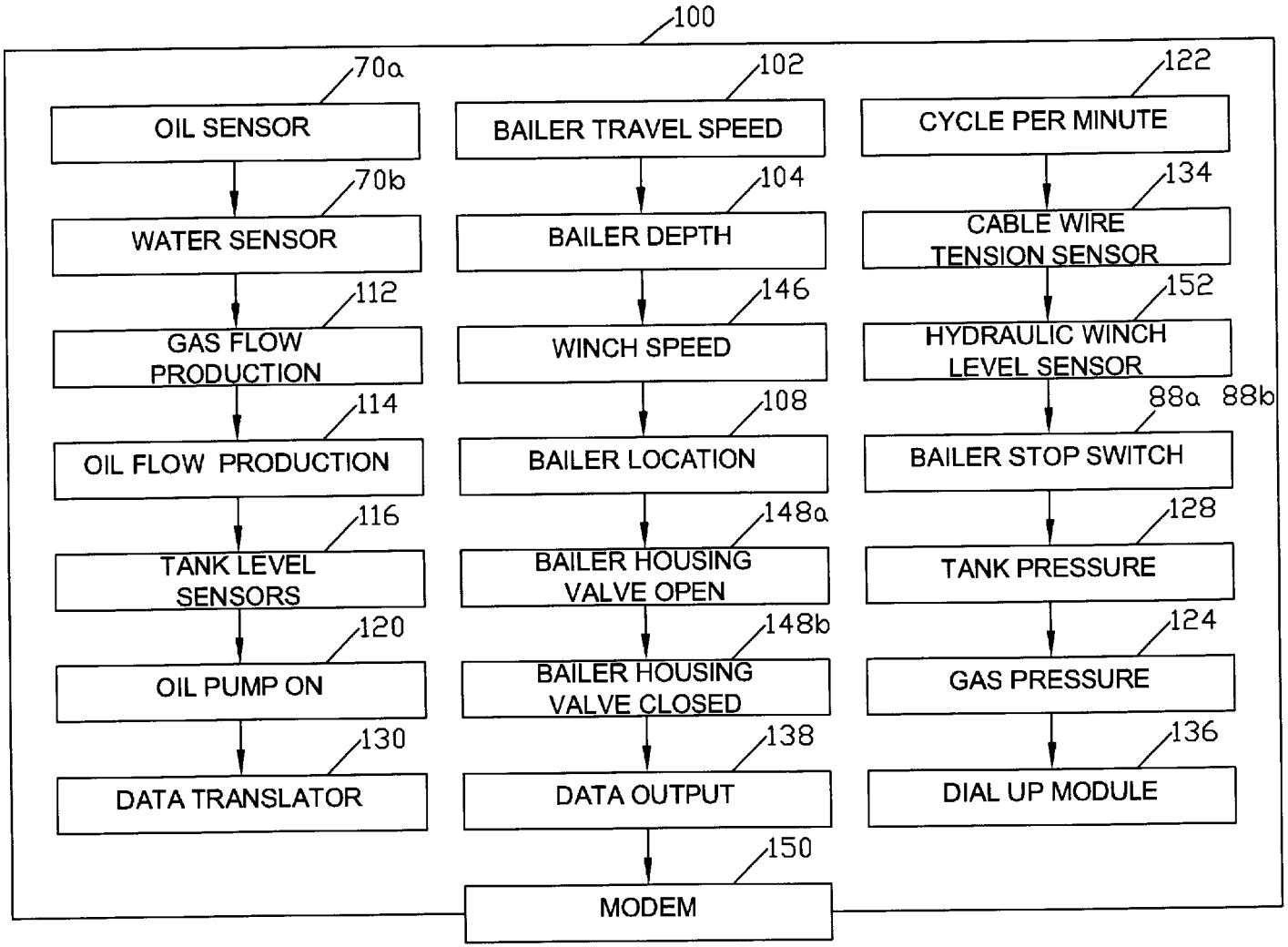
FIG. 5*d* is a diagrammatic flow chart depicting various operational parameters and characteristics monitored and controlled by the PLC.
Figure 5E:
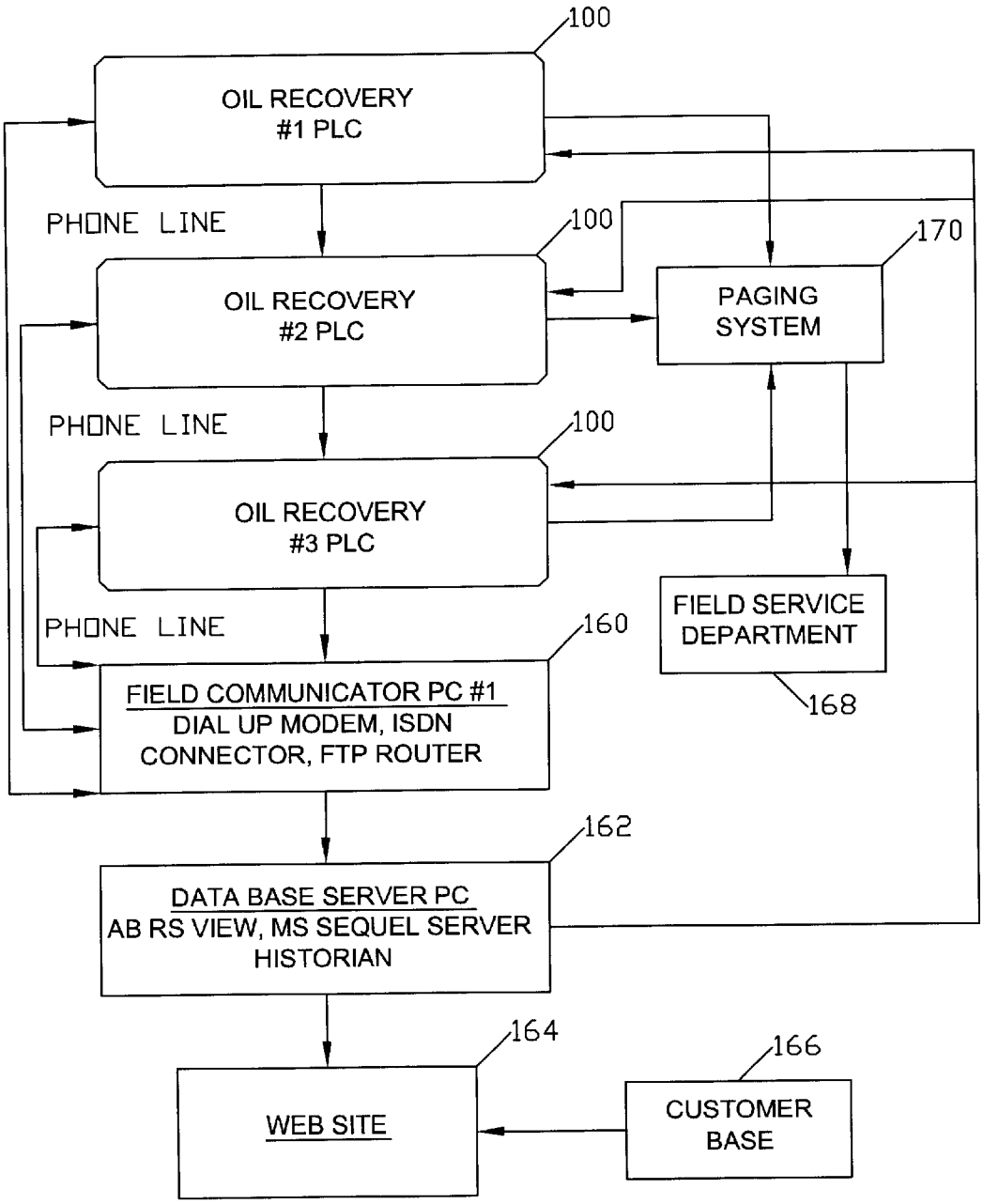
FIG. 5*e* is a diagrammatic chart depicting an embodiment of the invention in which several individual field site PLCs, which are connected through a paging system to a Field Service Department, are also in modem communication with one or more Field Communicator PCs, which in turn route data to a server which can be accessed from a website.
Figure 6A:
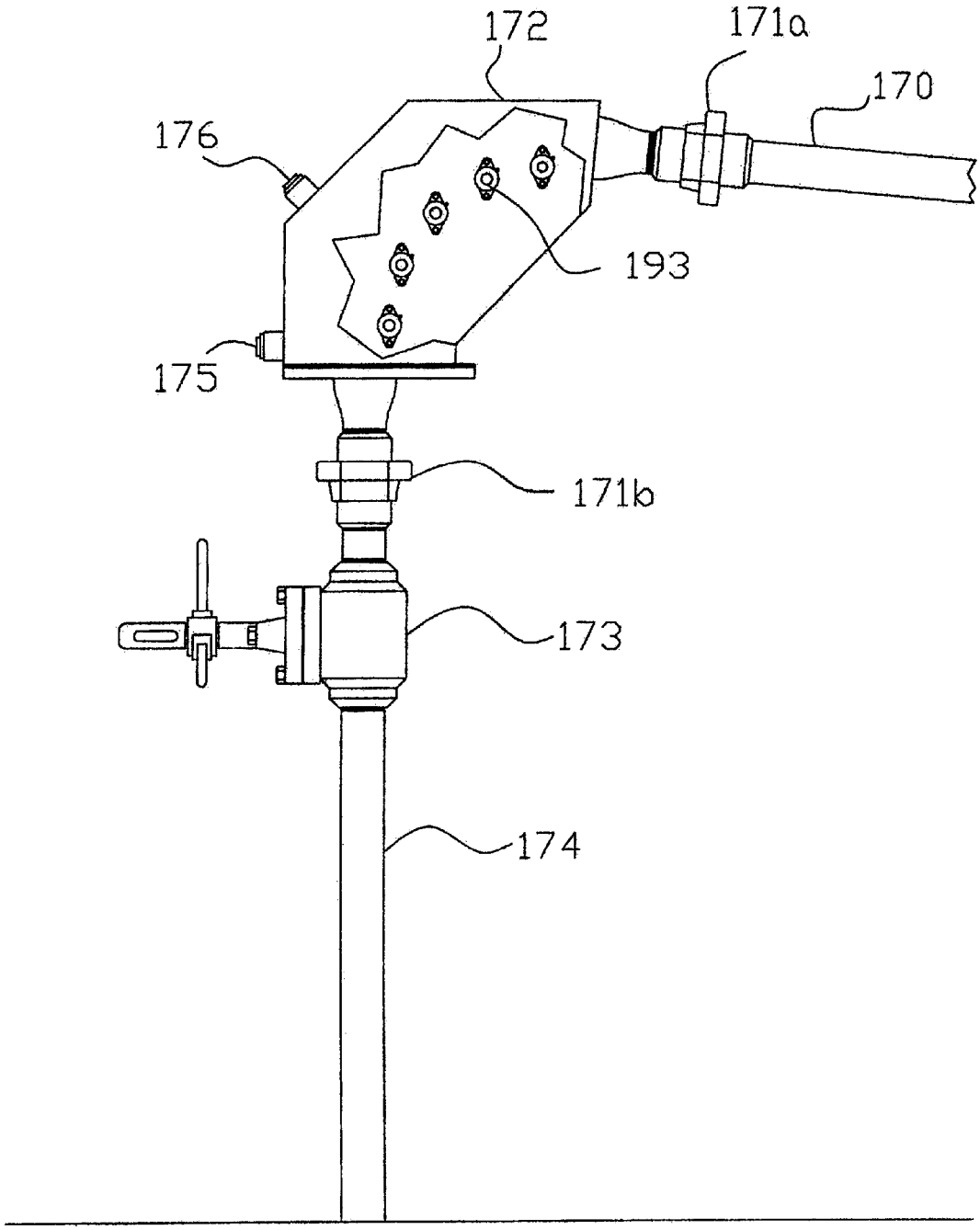
FIG. 6*a* is a schematic partial view of a lower portion of an alternative embodiment of the invention.
Figure 6B:
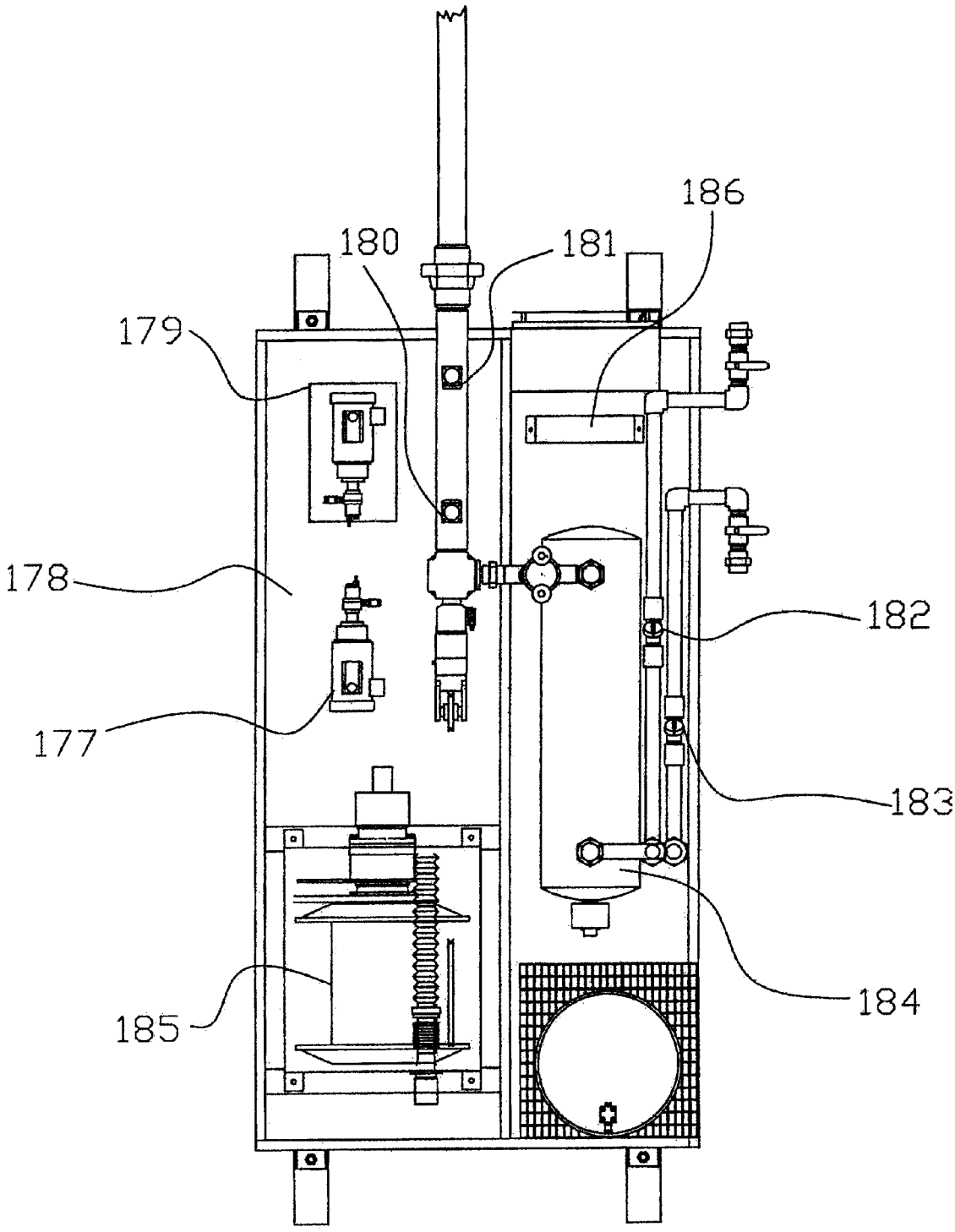
FIG. 6*b* is a schematic partial view of an upper portion of the invention looking from an edge view.
Figure 6C:
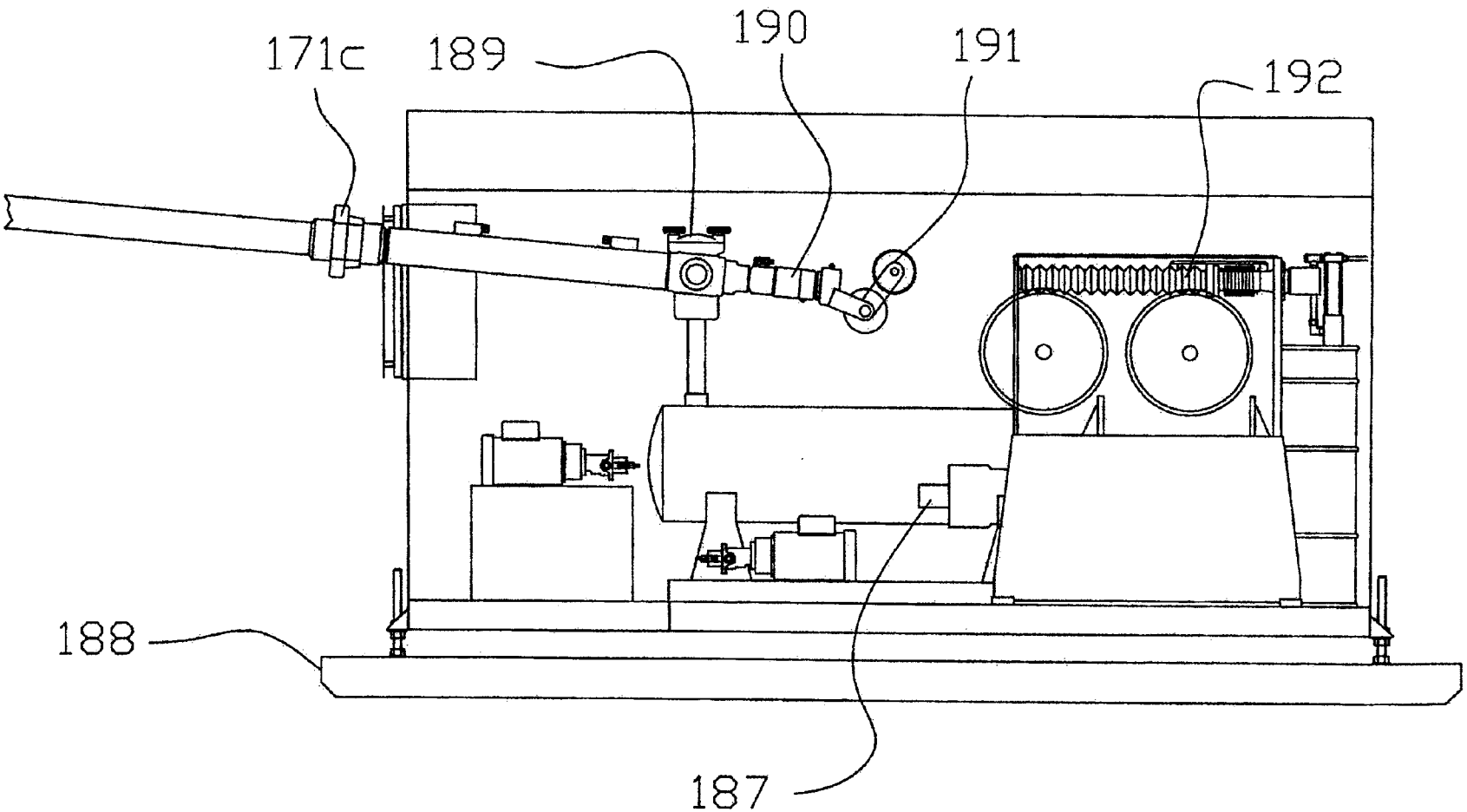
FIG. 6*c* is a schematic partial view of the upper portion of FIG. 1*b* looking from a side view.
Figure 6D:
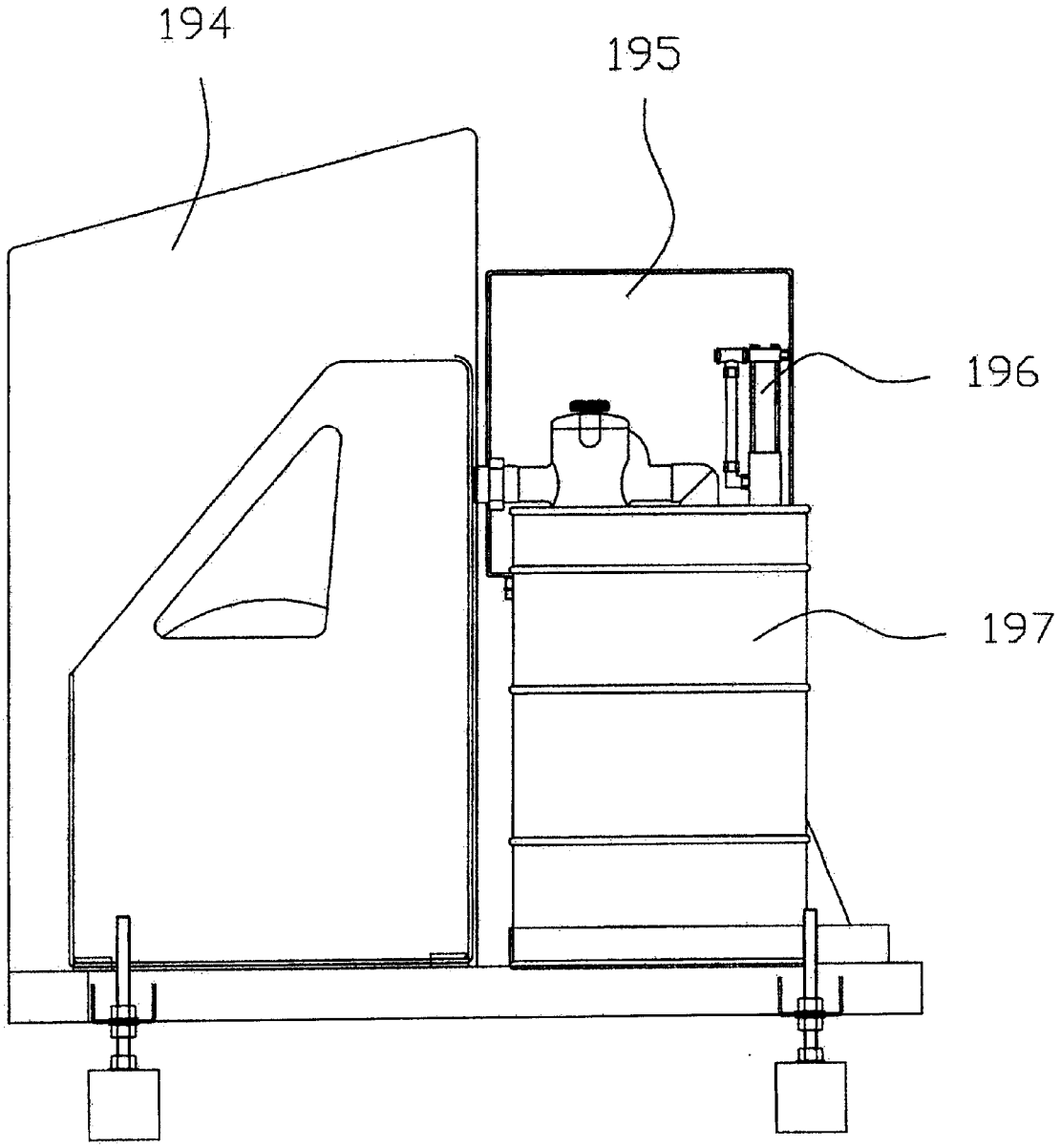
FIG. 6*d* is a schematic partial view from the side of the lower portion of the invention.
Figure 7:
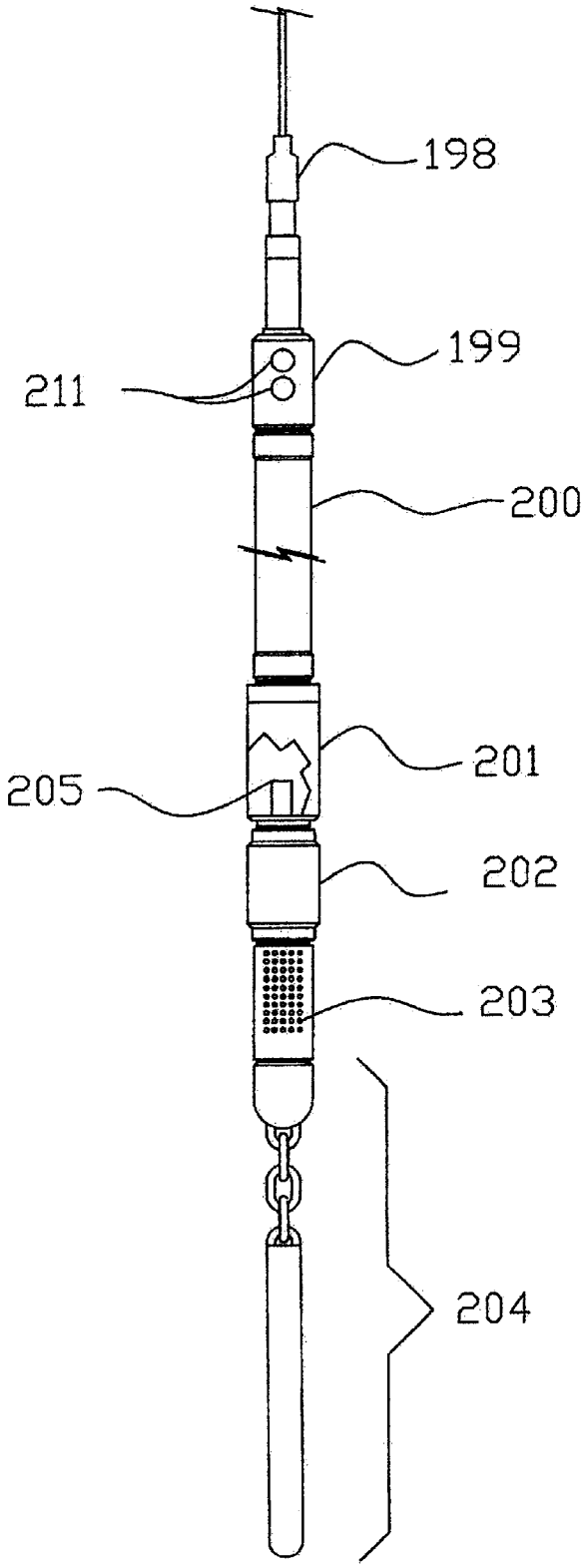
FIG. 7 is a schematic view of an alternative embodiment of a bailer tube assembly according to the present invention.
Figure 8:
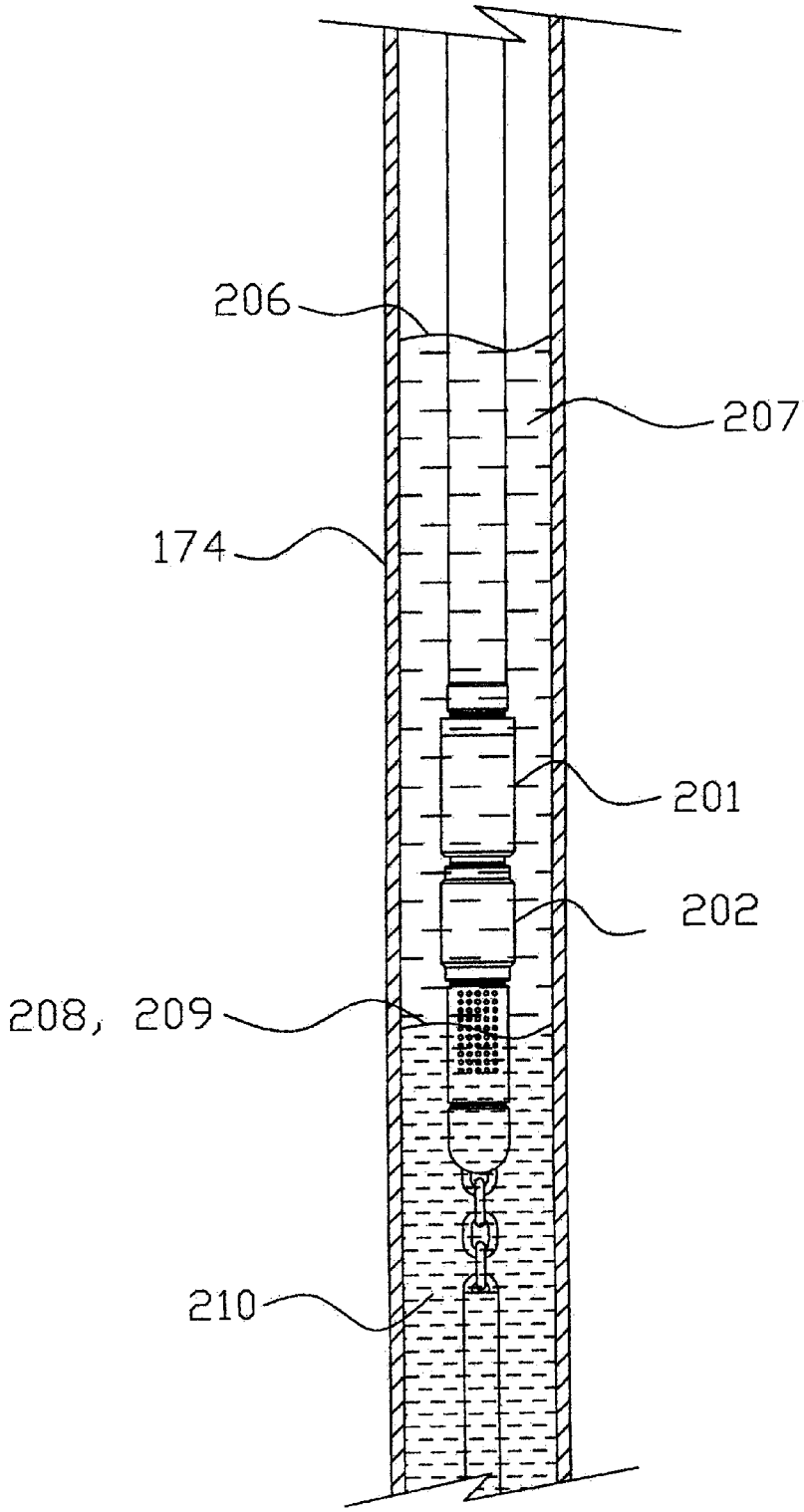
FIG. 8 is a conceptual depiction of the end of the bailer tube of FIG. 7 inside the well casing at an optimum depth.
Figure 9:
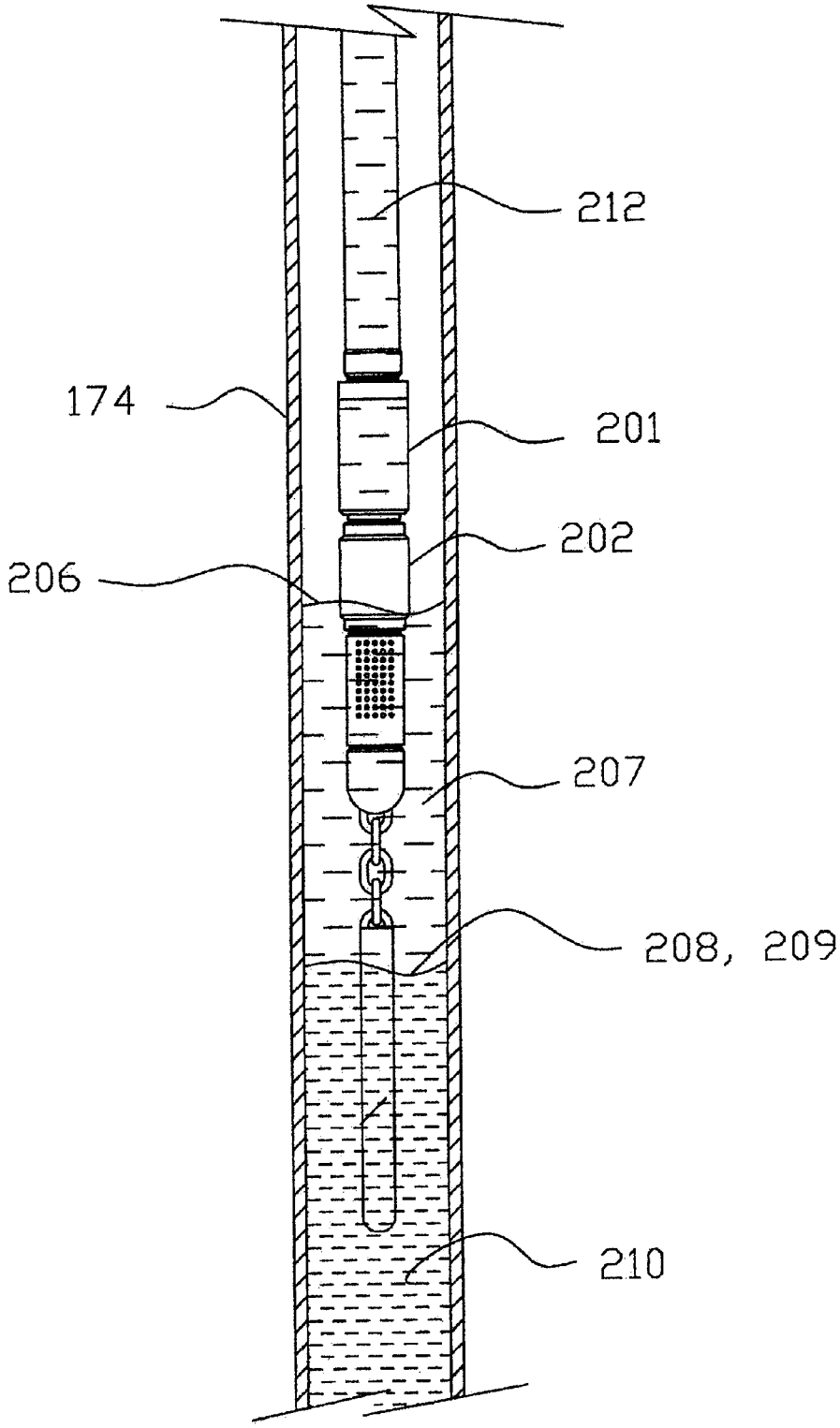
FIG. 9 is a schematic view of the bailer tube of FIG. 7 depicting a captured oil column ascending out of the well casing.

In another embodiment of the invention, multiple apparatus and control systems 10 may be located at various field sites and centrally monitored and controlled. For example, FIG. 5*e* depicts one or more apparatus and control systems at one site or multiple sites, in this case, three oil recovery/PLC units denoted as #1, #2 and #3 respectively, which are in communication with a paging system 170 for communication with a Field Service Department 168 which may be located at or near the sites or remotely some distance away. Field service operators may use this communication means to operationally monitor and control each field installation. Similarly, each apparatus and control systems 10 is in communication a field communicator PC 160 using a dial up modem, an ISDN connector and a FTP router. The field communicator PC transfers data 138 to a data base server PC 162, which may be located at a central data processing site. This server PC 162 typically may utilize an AB RS View software, an Microsoft sequel server data base software and a historian software to analyze, manipulate, store, display data and graphics, among many other functions.

For aid in understanding the interrelationship and capabilities of the invention, the following definitions are provided. The dial up modem is used to go online with a CPU from a remote location to report for down time faults, among other parameters. It typically can provide for up to 244 different paging alarms of pre-set messages. An ISDN connection or Integrated Services Digital Network is set of international communication standards, which are accepted worldwide by communication carriers using a router, that plugs into a phone line jack. ISDN connections can be up to 5 times faster than analog dial up. An FTP (File Transfer Protocol) Router is a device, which allows a specific file or files in a defined location on a hard drive, to be accessed for downloading across the internet. An ALLEN-BRADLEY® ROCKWELL SOFTWARE® View software (AB RS) is an example of a custom graphic interface software package, which can directly communicate with a known process, thereby allowing users to change operating parameters. Changes can include feed rate, operating speeds and flow rates, among other parameters. This type of software can also provide machine or equipment history, alarm history, and performs diagnostics. A MICROSOFT® sequel server (PC) is a data base system written by Microsoft Corporation for storing, organizing and polling large amounts of data. Other similar systems are known in the art. The historian software is a software package for data collection, reporting, analysis and visualization, including graphics, display. With the integration of these described features, a website 164 may be used to access data from the server 162 by the customer base 166.

For example, apparatus 10 may be installed in one field site location, or multiple apparatus 10 may be installed at or near the same location, or one or more apparatus 10 may be installed at multiple field site locations. Each of these installations, no matter where located, whether it be in a particular state, country or continent, may be connected to a regional field communicator 160 supporting the installations. The server 162 may however be located in a different state, country or continent and accessible from anywhere in the world using the website 164.

The apparatus 10 is generally arranged as diagrammatically depicted in FIGS. 1*a*–1*d* and structurally supported by a support frame 60 which is built to suit the configuration and may include a ladder to reach the pulley means 64, a base platform, necessary braces, etc.

Referring now to FIGS. 6*a* through 6*d*, in an alternative embodiment, a bailer is pulled through a bailer housing 170 by way of a 4" misalignment unions 171*a*, 171*b*, 171*c*, well head 172, a 4" gate valve 173 and existing well casing 174. The bailer is pulled through the well head over a roller guide 193. A drain port 175 and a liquid injection port 176 serve their normal functions.

An oil pump/motor 177, a drip pan 178, a hydraulic power supply-grease injection 179, and resistor 186 perform their normal functions. An oil flow meter 182 and gas flow meter 183 measure oil and gas flow respectively from an oil/gas separator 184. A fixed position wire line wench 185 operates basically as shown and described in the previous embodiment.

A variable frequency drive (vfd) 187, drive wench 185, and the entire unit rest on a wooden skid 188. A strainer 189, line wiper 190, cable tracker 191, level wind 192, roller guide 193, cover 194, electrical control panel 195, grease pump 196, 55 gallon container of line grease 197 and quick disconnect 198 are well known in the art and function in the expected manner. A bailer 200 includes a top portion 199, a sensor housing 201, check valve 202, intake filter 203, a weight 204 to help lower the bailer and a sensor 205. The top 206 and the bottom 208 of the oil level mark the range of oil 207. Similarly, the top 209 of the water 210 marks the boundary of the water.

Vent holes 211 are also used for emptying bailer 200 of captured oil 212 because in this embodiment, after the bailer is pulled through the roughly 90 degree wellhead 172 before being emptied into oil/gas separator 184. E-stop sensor 180, stop sensor 181 direct the discharged oil into oil/gas separator 184.

As seen from the foregoing description, the present invention satisfies a long felt need to provide a device in generally low producing wells which can account for the rate of replenishment of oil in the well bore such that only oil is removed as opposed to the removal of combined oil and water, the latter requiring a much higher production cost to separate the water and to re-inject the water back into the well bore.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus and system control for the removal of fluids and gas from a well having a well casing comprising:

a bailer tube sized to allow an up and down travel of said bailer tube inside the well casing and inside a bailer tube housing assembly vertically aligned with the well casing;

the bailer tube housing assembly having at least one valve for selectively opening the bailer tube housing assembly when allowing the bailer tube to travel into the well casing and for closing the bailer tube housing assembly after the bailer tube has traveled up into the bailer tube housing assembly and for directing a captured column of oil to a temporary storage tank;

a programmable logic controller for monitoring, operating and controlling the apparatus and for translating readable information to obtain and record operational parameters;

a lower end of the bailer tube having a bailer valve for selectively capturing the column of oil inside the well casing when said bailer tube is lowered therein, and for discharging said captured column of oil into the temporary storage tank when said bailer tube is raised out of the well casing, the bailer valve being in operative communication with the programmable logic controller;

wherein the lower end of the bailer tube further includes at least one sensor in operative communication with the programmable logic controller for differentiating between the water and oil inside the well casing as the bailer tube descends therein, the at least one oil and water sensor facilitating the defining of a top of the water and a bottom of a well casing column of oil;

wherein the programmable logic controller calculates a substantially optimum depth required for removal of oil without water from the well casing and once correctly positioned, the bailer valve is closed thereby capturing oil inside said bailer tube and the bailer tube is elevated so that the bailer valve is inside the bailer housing assembly and above the at least one valve at which location, the at least one valve is closed after which the bailer valve is opened and the captured oil in the bailer tube is discharged into the temporary storage tank, wherein the at least one valve, the driven winch means, the at least one oil and water sensor are each in electrical and operative communication with the programmable logic controller, and wherein the programmable logic controller controls and monitors the speed of the bailer tube inside the well casing as the bailer tube is being lowered into and elevated out of the well casing.

2. The apparatus and system control for the removal of fluids and gas from a well according to claim 1, further comprising:

natural gas recovery means for recovering a natural gas exhausting from the well casing.

3. The apparatus and system control for the removal of fluids and gas from a well according to claim 2, wherein the natural gas recovery means comprises:

a gas and oil separator;

the gas and oil separator directing the natural gas exiting the well casing from a location below the at least one valve; and the gas and oil separator further including means for draining a condensate and means for directing a separated gas to gas distribution means.

4. The apparatus and system control for the removal of fluids and gas from a well according to claim 3, wherein the natural gas recovery means further comprises:

means for monitoring one of a flow rate of natural gas exhausting from the well casing, a volumetric quantity of natural gas exhausting from the well casing, and a combination thereof.

5. The apparatus and system control for the removal of fluids and gas from a well according to claim 4, wherein a corresponding natural gas recovery means data from the means for monitoring one of the flow rate of natural gas exhausting from the well casing, the volumetric quantity of natural gas exhausting from the well casing, and the combination thereof is transmitted to the programmable logic controller.

6. The apparatus and system control for the removal of fluids and gas from a well according to claim 1, wherein the at least one oil and water sensor is a ground probe switch which is activated when a conductive path between a terminal of said ground probe switch is established as the terminal contacts the water under the oil in the well casing thereby defining the top of the water and the bottom of the well casing column of oil.

7. The apparatus and system control for the removal of fluids and gas from a well according to claim 1, wherein the driven winch means further comprises encoder means in electrical communication with the programmable logic controller for converting a rotation of the winch means into a linear motion to determine a speed of the bailer tube traveling inside the well casing and a location within said well casing.

8. The apparatus and system control for the removal of fluids and gas from a well according to claim 1, wherein the at least one valve is an actuated 3-way valve comprising a slide gate valve and a ball valve.

9. The apparatus and system control for the removal of fluids and gas from a well according to claim 1, further comprising:

pulley means proximate an upper end of and above the bailer tube housing assembly over which a cable wire attached to an upper end of the bailer tube is run;

an opposite end of the cable wire being attached to driven winch means for pulling the bailer tube out of the well casing and for lowering the bailer tube into the well casing; and support and guide means at the upper end of the bailer housing assembly for supporting and guiding the wire cable.

10. The apparatus and system control for the removal of fluids and gas from a well according to claim 9, wherein the support and guide means comprises:

a stuffing box and sheave assembly including at least one wire cable line wiper and at least one hydraulic greasing port for greasing said wire cable.

11. The apparatus and system control for the removal of fluids and gas from a well according to claim 10, wherein the stuffing box and sheave assembly includes a first hydraulic greasing port in overlying relationship to a first line wiper, a second hydraulic greasing port in underlying relationship to the first line wiper and a second line wiper in underlying relationship to the second hydraulic greasing port.

12. The apparatus and system control for the removal of fluids and gas from a well according to claim 1, further comprising a proximity sensor switch located proximate the upper end of the bailer housing assembly, the proximity sensor switch being in electrical communication with the programmable logic controller and being means for stopping the bailer tube being raised from the well casing.

13. The apparatus and system control for the removal of fluids and gas from a well according to claim 12, further comprising a back up proximity sensor switch located in a predetermined spaced apart relationship with the proximity sensor switch and being means for stopping the bailer tube should the proximity sensor switch fail, the back up proximity sensor switch being in electrical communication with the programmable logic controller.

14. The apparatus and system control for the removal of fluids and gas from a well according to claim 1, wherein the programmable logic controller further monitors a top of the oil column location within the well casing as well as a bottom location of the oil column within the well casing, the bottom location corresponding to a location of the top of the water column within the well casing.

15. The apparatus and system control for the removal of fluids and gas from a well according to claim 14, wherein the optimum depth in the well casing of the lower end of the bailer tube for capturing the column of oil without water is an intermediate location between the location of the top of the oil column and above the location of the bottom of the oil column.

16. The apparatus and system control for the removal of fluids and gas from a well according to claim 15, wherein the programmable logic controller performs an operational logging sequence during which the programmable logic controller operationally opens the bailer valve and the at least one valve, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the lower end of the bailer tube enters into the oil column at which point the at least one oil sensor identifies a depth of the top of the oil column, the lower end of the bailer tube continues to descend until the at least one water sensor identifies a depth of the top of the water in the well casing, transmits data reflective of the identification of the depth of the top of the oil and water to the programmable logic controller which recalculates desired operational parameters including a new logging depth, optimum depth and bailer tube travel speed, closes the bailer valve, starts elevating the bailer tube through the well casing until the bailer tube enters the bailer tube housing assembly, stops the bailer tube when the lower end of the bailer tube is above the at least one valve, closes the at least one valve, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired.

17. The apparatus and system control for the removal of fluids and gas from a well according to claim 15, wherein the programmable logic controller performs a balanced oil production operational sequence during which the programmable logic controller operationally opens the bailer valve and the at least one valve, starts the lowering of the bailer tube into the well casing accelerating to a predetermine adjustable travel speed, allows the bailer tube to descend to a pre-set logging depth above the location of the top of the oil column within the well casing, decreases the adjustable travel speed so that the second end of the bailer tube enters into the oil column at which point the at least one oil sensor identifies a depth of the top of the oil column, the lower end of the bailer tube continues to descend into the oil column and stops at the optimum depth at which point the bailer valve is closed after a predetermined preset dwell time to capture oil, transmits data reflective of the identification of the depth of the top of the oil and optimum depth to the programmable logic controller which continually calculates and monitors desired operational parameters including the logging depth, optimum depth and bailer tube travel speed, starts elevating the bailer tube through the well casing until the upper end of the bailer tube enters the bailer tube housing assembly, stops the bailer tube when the lower end of the bailer tube is above the at least one valve, closes the at least one valve, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence as desired.

18. The apparatus and system control for the removal of fluids and gas from a well according to claim 1, wherein the programmable logic controller further monitors an accumulated level of oil in the temporary storage tank.

19. The apparatus and system control for the removal of fluids and gas from a well according to claim 1, wherein the programmable logic controller further monitors gaseous pressure.

20. The apparatus and system control for the removal of fluids and gas from a well according to claim 1, wherein the programmable logic controller further monitors oil pressure in the well casing and temporary storage tank using corresponding pressure sensor means.

21. The apparatus and system control for the removal of fluids and gas from a well according to claim 1, further including:

pulley means proximate an upper end of and above the bailer tube housing assembly over which a cable wire attached to an upper end of the bailer tube is run;

an opposite end of the cable wire being attached to driven winch means for pulling the bailer tube out of the well casing and for lowering the bailer tube into the well casing wherein the programmable logic controller further monitors a tension in the cable wire.

22. The apparatus and system control for the removal of fluids and gas from a well according to claim 1, further comprising a field communicator being operatively in communication with the programmable logic controller, the field communicator being operatively in communication with a data base server, the data base server for storing, organizing and polling data outputted from the programmable logic controller, for users to change operating parameters of the programmable logic controller, for providing historical data and performing diagnostics, and for providing data collection, reporting, analysis and visualization displays.

23. The apparatus and system control for the removal of fluids and gas from a well according to claim 22, wherein the data base server is accessible by a user through a website.

24. The apparatus and system control for the removal of fluids and gas from a well according to claim 1, further comprising a paging system in operative communication with the programmable logic controller, the paging system for communicating pre-set alarms and messages between a field service department and the programmable logic controller.

25. A method for the removal of oil and gas without water from a well comprising the steps of:

a bailer tube sized to allow an up and down travel of said bailer tube inside the well casing and inside a bailer tube housing assembly vertically aligned with the well casing;

selectively opening the bailer tube housing assembly when allowing the bailer tube to travel into the well casing and for closing the bailer tube housing assembly after the bailer tube has traveled up into the bailer tube housing assembly and for directing a captured column of oil to a temporary storage tank;

selectively capturing the column of oil inside the well casing when said bailer tube is lowered therein, and for discharging said captured column of oil into the temporary storage tank when said bailer tube is raised out of the well casing, the bailer valve being in electrically operative communication with a programmable logic controller;

monitoring, operating and controlling the apparatus and translating readable information to obtain and record operational parameters;

differentiating between the water and oil inside the well casing as the bailer tube descends therein, at least one oil and water sensor facilitating the defining of a top of the water and a bottom of a well casing column of oil;

calculating a substantially optimum depth required for removal of oil without water from the well casing and once correctly positioned, capturing oil inside said bailer tube and elevating the bailer tube so that the bailer valve is inside the bailer housing assembly and discharging the captured oil in the bailer tube into the temporary storage tank, conducting a first sequence logging process comprising lowering of the bailer tube into the well casing accelerating to a predetermine adjustable travel speed, allowing the bailer tube to descend to a pre-set logging depth above the location of the top of the oil column within the well casing, decreasing the adjustable travel speed so that the lower end of the bailer tube enters into the oil column at which point the at least one oil sensor identifies a depth of the top of the oil column, the second end of the bailer tube continues to descend until the at least one water sensor identifies a depth of the top of the water in the well casing, transmits data reflective of the identification of the depth of the top of the oil and water to the programmable logic controller which recalculates desired operational parameters including a new logging depth, optimum depth and bailer tube travel speed, closes the bailer valve, starts elevating the bailer tube through the well casing until the bailer tube enters the bailer tube housing assembly, stops the bailer tube when the lower end of the bailer tube is above the at least one valve, closes the at least one valve, opens the bailer valve for a predetermined top dwell time thereby discharging the captured oil in the bailer tube inside the temporary storage tank, closes the bailer valve after the captured oil has been discharged into the temporary storage tank, and repeats the above operational logging sequence as desired; and performing a balanced oil production operational sequence during which the programmable logic controller operationally opens the bailer valve and the at least one valve, starts the lowering of the bailer tube into the well casing accelerating to the predetermine adjustable travel speed, allows the bailer tube to descend to the pre-set logging depth above the location of the top of the oil column within the well casing, decreases the adjustable travel speed so that the lower end of the bailer tube enters into the oil column at which point the at least one oil sensor identifies the depth of the top of the oil column, the lower end of the bailer tube continues to descend into the oil column and stops at the optimum depth at which point the bailer valve is closed after the predetermined preset dwell time to capture oil, transmits the data reflective of the identification of the depth of the top of the oil and optimum depth to the programmable logic controller which continually calculates and monitors desired operational parameters including the logging depth, optimum depth and bailer tube travel speed, starts elevating the bailer tube through the well casing until the first end of the bailer tube enters the temporary storage tank, stops the bailer tube when the lower end of the bailer tube is above the at least one valve, closes the at least one valve, opens the bailer valve for a predetermined top dwell time thereby discharging the captured oil in the bailer tube inside the temporary storage tank, closes the bailer valve after the captured oil has been discharged into the temporary storage tank, and repeats the above balanced oil production operational sequence until a change in depth is noted such as to require re-initiation of the logging process.

26. The method according to claim 25, wherein the programmable logic controller can be programmed to cycle through the first sequence logging process at predetermined time intervals.

27. The method according to claim 26, further including:

monitoring the rate that the oil column is decreasing or increasing and makes necessary adjustments to slow down or speed up a normal running sequence, running sequence normally starts out with the travel speed at an optimum operating speed and as a rate of the oil column is decreasing, the programmable logic controller compares this rate with a current rate of speed of the bailer tube and slows the travel speed of the bailer tube slightly with every cycle, and wherein while monitoring the rate of decrease of the oil column, the programmable logic controller continuously makes small adjustments until the oil column stops decreasing in size and maintains a steady constant size.

28. The method according to claim 27, wherein the programmable logic controller continues to run at the travel speed of the bailer tube while continuing to monitor the size of the oil column, and continues to make adjustments in order to maintain a balanced sized oil column.

* * * * *